US007635324B2

(12) United States Patent
Balis

(10) Patent No.: US 7,635,324 B2
(45) Date of Patent: Dec. 22, 2009

(54) EXTENSOR MUSCLE BASED POSTURAL REHABILITATION SYSTEMS AND METHODS WITH INTEGRATED MULTIMEDIA THERAPY AND INSTRUCTIONAL COMPONENTS

(76) Inventor: Anastasios Balis, 542 Norwich Rd., Plainfield, CT (US) 06374

( * ) Notice: Subject to any disclaimer, the term of this patent is extended or adjusted under 35 U.S.C. 154(b) by 0 days.

(21) Appl. No.: 11/728,438

(22) Filed: Mar. 26, 2007

(65) Prior Publication Data

US 2007/0270295 A1 Nov. 22, 2007

Related U.S. Application Data

(63) Continuation of application No. 11/541,920, filed on Oct. 2, 2006, now abandoned.

(60) Provisional application No. 60/723,305, filed on Oct. 4, 2005.

(51) Int. Cl.
*A63B 26/00* (2006.01)

(52) U.S. Cl. ..... 482/142; 482/8; 482/902; 482/907; 600/595; 434/247

(58) Field of Classification Search ..... 482/142, 482/146, 148, 902, 907, 8; 297/170–174; 280/250.1; 600/587, 594, 595, 558, 559; 434/247, 256, 257, 307 R; 601/37
See application file for complete search history.

(56) References Cited

U.S. PATENT DOCUMENTS 3,759,511 A * 9/1973 Zinkin et al. ..... 482/51
3,949,983 A * 4/1976 Tommasino ..... 482/142
4,456,086 A * 6/1984 Wier et al. ..... 180/11
4,569,094 A * 2/1986 Hart et al. ..... 5/87.1
4,569,401 A * 2/1986 Luck ..... 482/57
4,725,054 A * 2/1988 Solow et al. ..... 482/137
4,725,055 A * 2/1988 Skowronski ..... 482/134
4,725,056 A * 2/1988 Rehrl et al. ..... 482/134
4,732,381 A * 3/1988 Skowronski ..... 482/134
4,753,126 A * 6/1988 Sammaratano ..... 74/526
4,768,779 A * 9/1988 Oehman et al. ..... 482/10
4,796,881 A * 1/1989 Watterson ..... 482/73

(Continued)

FOREIGN PATENT DOCUMENTS

WO WO0028930 A2 5/2000

(Continued)

OTHER PUBLICATIONS

Lee, M.Y., et al., "Clinical Evaluation of New Biofeedback Standing Balance Training Device," *J. Med. Eng. Technol.*, 20(2):60-6 (1996).

(Continued)

*Primary Examiner*—Loan H Thanh
*Assistant Examiner*—Daniel F Roland
(74) *Attorney, Agent, or Firm*—Hamilton, Brook, Smith & Reynolds, P.C.

(57) ABSTRACT

The present invention provides upright, standing, and weight bearing support system for the sternum, arms, and pelvis. The present invention maintains the subject in an ideal posture position, while the guiding the subject through therapeutic exercises that have a specific and practical application towards standing up straight. The system provides video and audio stimulation, educational instruction, and evokes potential central nervous system stimulation.

19 Claims, 21 Drawing Sheets

U.S. PATENT DOCUMENTS 4,869,509 A * 9/1989 Lee ..... 473/209
4,893,808 A * 1/1990 McIntyre et al. ..... 482/5
4,915,373 A * 4/1990 Walker ..... 482/51
4,928,709 A * 5/1990 Allison et al. ..... 600/595
5,054,852 A * 10/1991 Tholkes ..... 297/172
5,070,863 A * 12/1991 McArthur et al. ..... 601/26
5,092,835 A * 3/1992 Schurig et al. ..... 600/9
5,094,249 A * 3/1992 Marras et al. ..... 600/594
5,094,445 A * 3/1992 Winkelvoss ..... 482/42
5,158,089 A * 10/1992 Swezey et al. ..... 600/595
5,203,346 A * 4/1993 Fuhr et al. ..... 600/594
5,308,296 A * 5/1994 Eckstein ..... 482/5
5,324,247 A * 6/1994 Lepley ..... 482/134
5,403,251 A * 4/1995 Belsito et al. ..... 482/4
5,425,378 A * 6/1995 Swezey et al. ..... 600/595
5,433,690 A * 7/1995 Gilman ..... 482/146
5,476,103 A * 12/1995 Nahsner ..... 600/595
5,484,151 A * 1/1996 Tholkes ..... 280/250.1
5,487,590 A * 1/1996 Haynes ..... 297/344.14
5,502,851 A * 4/1996 Costello ..... 5/86.1
5,542,746 A * 8/1996 Bujaryn ..... 297/423.12
5,544,649 A * 8/1996 David et al. ..... 600/301
5,599,262 A * 2/1997 Shih ..... 482/147
5,618,250 A * 4/1997 Butz ..... 482/137
5,618,251 A * 4/1997 Sullivan ..... 482/146
5,638,300 A * 6/1997 Johnson ..... 702/153
5,647,375 A * 7/1997 Farfan de los Godos .... 600/594
5,695,439 A * 12/1997 Lin ..... 482/146
5,722,420 A * 3/1998 Lee ..... 600/546
5,746,684 A * 5/1998 Jordan ..... 482/62
5,810,751 A * 9/1998 Meier et al. ..... 601/24
5,888,182 A * 3/1999 Shih ..... 482/147
5,891,060 A * 4/1999 McGregor et al. ..... 600/595
5,907,819 A * 5/1999 Johnson ..... 702/152
5,916,181 A * 6/1999 Socci et al. ..... 600/595
5,941,807 A * 8/1999 Cassidy et al. ..... 482/146
5,954,674 A * 9/1999 Fuhr ..... 600/594
5,961,541 A * 10/1999 Ferrati ..... 607/49
6,048,324 A * 4/2000 Socci et al. ..... 600/595
6,176,817 B1 1/2001 Carey et al.
6,220,990 B1 * 4/2001 Crivello ..... 482/51
6,234,942 B1 * 5/2001 Yang ..... 482/132
6,234,982 B1 5/2001 Aruin
6,270,101 B1 * 8/2001 Hase ..... 280/250
6,343,802 B1 * 2/2002 Workman et al. ..... 280/87.041
6,440,046 B1 * 8/2002 Tholkes ..... 482/142
6,551,214 B1 * 4/2003 Taimela ..... 482/10
6,730,006 B1 5/2004 Patterson
6,730,047 B2 * 5/2004 Socci et al. ..... 600/595
D495,015 S * 8/2004 Tudico ..... D21/688
6,786,877 B2 * 9/2004 Foxlin ..... 600/587
6,832,770 B1 * 12/2004 Wright-Ott et al. .... 280/87.041
6,997,857 B2 * 2/2006 Bowman et al. ..... 482/148
7,004,895 B2 * 2/2006 Perry et al. ..... 482/146
7,036,512 B2 * 5/2006 Harnois ..... 128/845
7,070,548 B2 * 7/2006 Thonn, Jr. ..... 482/142
7,104,926 B2 * 9/2006 Carlson ..... 482/10
7,264,554 B2 * 9/2007 Bentley ..... 473/222
7,303,508 B2 * 12/2007 Toyama et al. ..... 482/51
7,356,858 B2 * 4/2008 Summers ..... 5/83.1
2002/0111257 A1 * 8/2002 Hur ..... 482/140
2002/0183177 A1 * 12/2002 Hoffman ..... 482/148
2004/0014566 A1 * 1/2004 Kao ..... 482/8
2004/0015108 A1 1/2004 McNally et al.
2004/0097839 A1 * 5/2004 Epley ..... 600/595
2004/0185991 A1 * 9/2004 Bowman et al. ..... 482/140
2004/0209751 A1 * 10/2004 Thonn, Jr. ..... 482/140
2006/0073941 A1 * 4/2006 Perry et al. ..... 482/51
2006/0100070 A1 * 5/2006 Abdo ..... 482/121
2007/0037663 A1 * 2/2007 Goel et al. ..... 482/1
2007/0161875 A1 * 7/2007 Epley ..... 600/301
2007/0249466 A1 * 10/2007 Chiari et al. ..... 482/1
2008/0004550 A1 * 1/2008 Einav et al. ..... 601/33
2008/0015091 A1 * 1/2008 Tyree ..... 482/79

FOREIGN PATENT DOCUMENTS

WO WO2004009183 A2 1/2004

OTHER PUBLICATIONS

"Basic Balance Master®," <URL:http://www.onbalance.com/neurocom/products/BasicBalanceMaster.aspx> [retrieved from http://web.archive.org/ on Nov. 20, 2007].
"PRO Balance Master®," <URL:http://www.onbalance.com/neurocom/products/PROBalanceMaster.aspx> [retrieved from http://web.archive.org/ on Nov. 20, 2007].
"SMART Balance Master®," <URL:http://www.onbalance.com/neurocom/products/SMARTBalanceMaster.aspx> [retrieved from http://web.archive.org/ on Nov. 20, 2007].
"EQUITEST®", Retrieved from the Internet, <URL:http://www.onbalance.com/neurocom/products/EquiTest.aspx> [retrieved on Apr. 21, 2005].
Huber Brochure (Coordination Balance Strengthening Posture), Copyright 2003.

* cited by examiner

EXTENSOR MUSCLE BASED POSTURAL REHABILITATION SYSTEMS AND METHODS WITH INTEGRATED MULTIMEDIA THERAPY AND INSTRUCTIONAL COMPONENTS

RELATED APPLICATION

This application is a continuation of U.S. application Ser. No. 11/541,920, filed on Oct. 2, 2006 now abandoned, which claims the benefit of U.S. Provisional Application No. 60/723,305, filed on Oct. 4, 2005. The entire teachings of the above application are incorporated herein by reference.

BACKGROUND

A major component of most muscular-skeletal injuries is an imbalance between the flexor muscle group and the extensor muscle group. The flexors are the muscles that cause the body to go into the fetal position when they are contracted. The physiological opposite of the flexors, are the extensors, which are muscles that cause a body to stand up in an erect position when they are contracted. Because of several physiological predispositions and a preponderance of flexor-based activities, the flexor muscle group tends to dominate the extensors. This flexor dominant posture is a key component in many injurious joint angulations and his or her resultant musculo-skeletal injuries. Many types of traditional physical rehabilitation involve flexor-based activation and result in an accentuation of the flexor domination, which is most likely the root of the problem.

SUMMARY

The present invention provides a unique and stable platform designed to facilitate a predominantly isometric styled set of muscular activations. By providing unique access to the extensor portion of the musculo-skeletal system, each regional extensor pool can be systematically activated, in order to build coherence of the total extensor pool. The total extensor pool has components in the musculo-skeletal systems, which are bound seamlessly via the peripheral nervous system to its somato-topic representation within the central nervous system.

A posture rehabilitation apparatus can be provided. The posture rehabilitation apparatus can include a human body positioning system. The human body positioning system can include a torso shroud and a chest pad connected to the torso shroud. The chest pad can be substantially between left and right arm supports. The human body positioning system can enable a human to stand in an upright position with ideal posture, while isolating and activating the extensor muscle groups of the human's body.

An integrated therapeutic multimedia system can be coupled to the human body position system. The integrated therapeutic multimedia system can be capable of providing the human with neurological rehabilitation. The integrated therapeutic multimedia system can include a video display device that enables neurological rehabilitation for the human by providing the human with video guided eye exercises. The integrated therapeutic multimedia system can includes a sound system that enables neurological rehabilitation for the human by providing the human with audio guided musculo-skeletal exercises. The integrated therapeutic multimedia system can include a sound system that enables neurological rehabilitation for the human by providing the human with sound and vibratory therapy. The sound vibration therapy can include chimes. The integrated therapeutic multimedia system can provide neurological rehabilitation by enabling the human to interact with a multimedia presentation of 3-D virtual reality exercise demonstrations.

The human body positioning system can provide a mechanism for monitoring the human's posture using biofeedback. The information obtained from the biofeedback can provide a means for evaluating the patient, for diagnosis or for generating a doctor's report of findings.

The human body positioning system can include a foot platform that provides foot support. The foot platform can be capable of moving to an up position and down position. The human body positioning system can include a seat for the user to sit on, while stile ensuring that the user can maintain upright ideal posture. The human body positioning system can include a combination of active and passive conservative musculo-skeletal therapy.

A method of rehabilitating posture can be provided. A user can be positioned in an upright position and can maintain ideal posture. The user can maintain the ideal posture while isolating and activating the extensor muscle groups of the user's body. The user can be provided with neurological rehabilitation while the user maintains the upright position by (a) providing the user with video guided eye exercises, (b) providing the user with audio guided musculo-skeletal exercises, (c) providing the user with sound and vibratory therapy, and (d) enabling the user to navigate through 3-D virtual reality guided exercises.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The present invention can provide both the therapist and the patient key tools for promoting ideal function of major portions of human physiology, making it a superior human physiology education system. Traditional therapies typically provide a face-down treatment, while the present invention provides treatment while the patient is standing in an upright position.

Preferably, the present invention provides a user friendly, ergonomically correct body-working platform, designed to promote an ideal relationship between key components of human physiology, namely the peripheral neuro musculo-skeletal system and its somato-topic representation within the central nervous system. When this ideal relationship is achieved, it can be represented by ideal posture and characterized by peak musculo-skeletal efficiency.

Figure 1A:
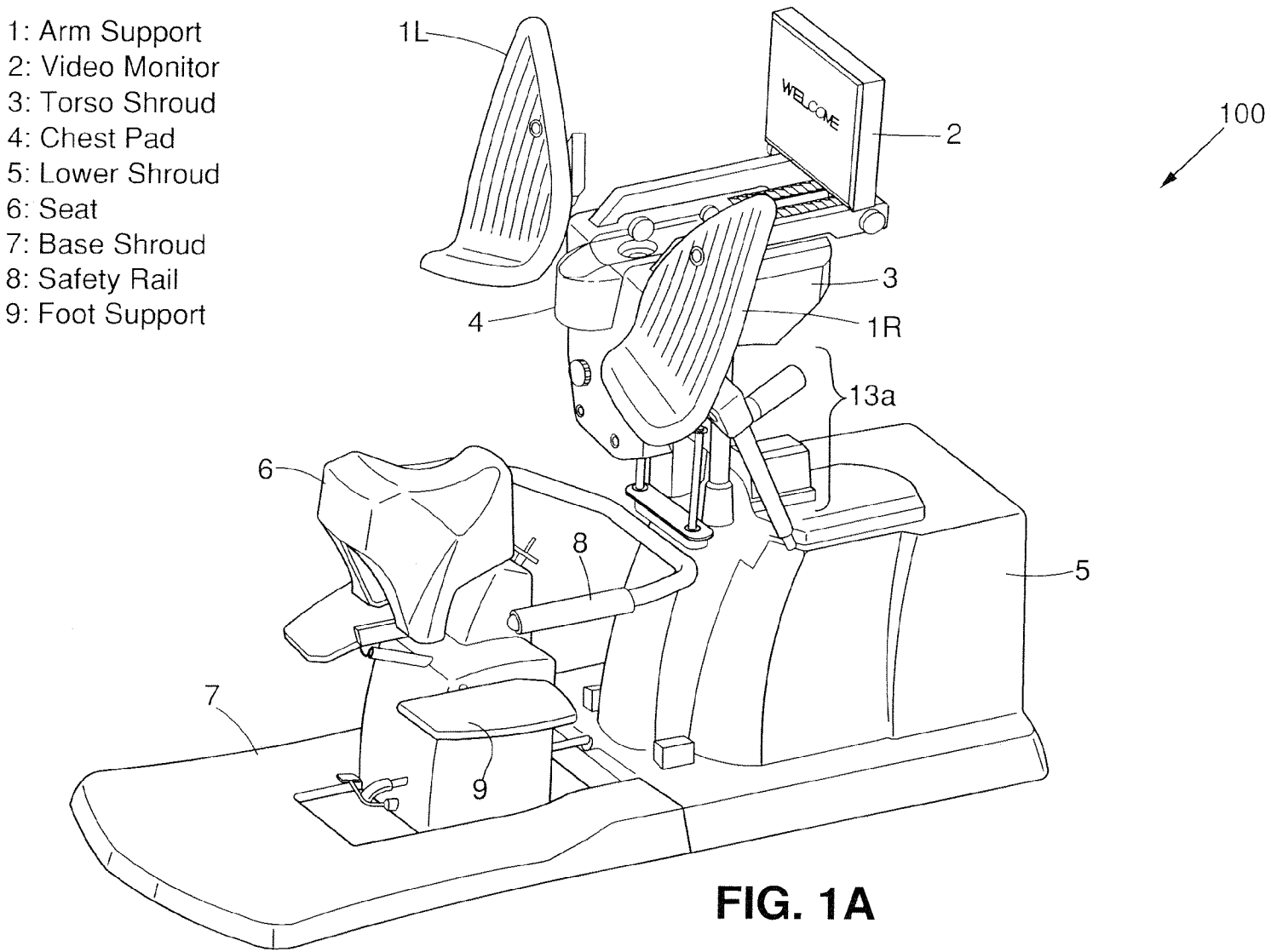
FIGS. 1A-1B are top, front, right side perspective views of the present invention.

FIG. 1A is a top, front, right side perspective view of the present invention. FIG. 2 is a front perspective view of the present invention. A left arm support wing assembly 1L is included and is capable of un-powered rotation that mimics the subject's left shoulder rotation. A right arm support wing assembly 1R is included and is capable of un-powered rotation that mimics the subject's right shoulder rotation. A video monitor 2 is mounted in a fixed position in front of the subject's face. A chest pad 4 is mounted to a torso shroud 3. The torso shroud 3 supports the chest pad 4. An adjusting device 13*a* can provide adjustments to the angle and height of various components of the system 100, including the chest pad 4 and arm supports 1R, 1L. The adjusting device 13*a* can provide adjustments to the total vertical height of the system 100. A standing platform or base shroud 7 is horizontal to the torso shroud 3.

Figure 2A:
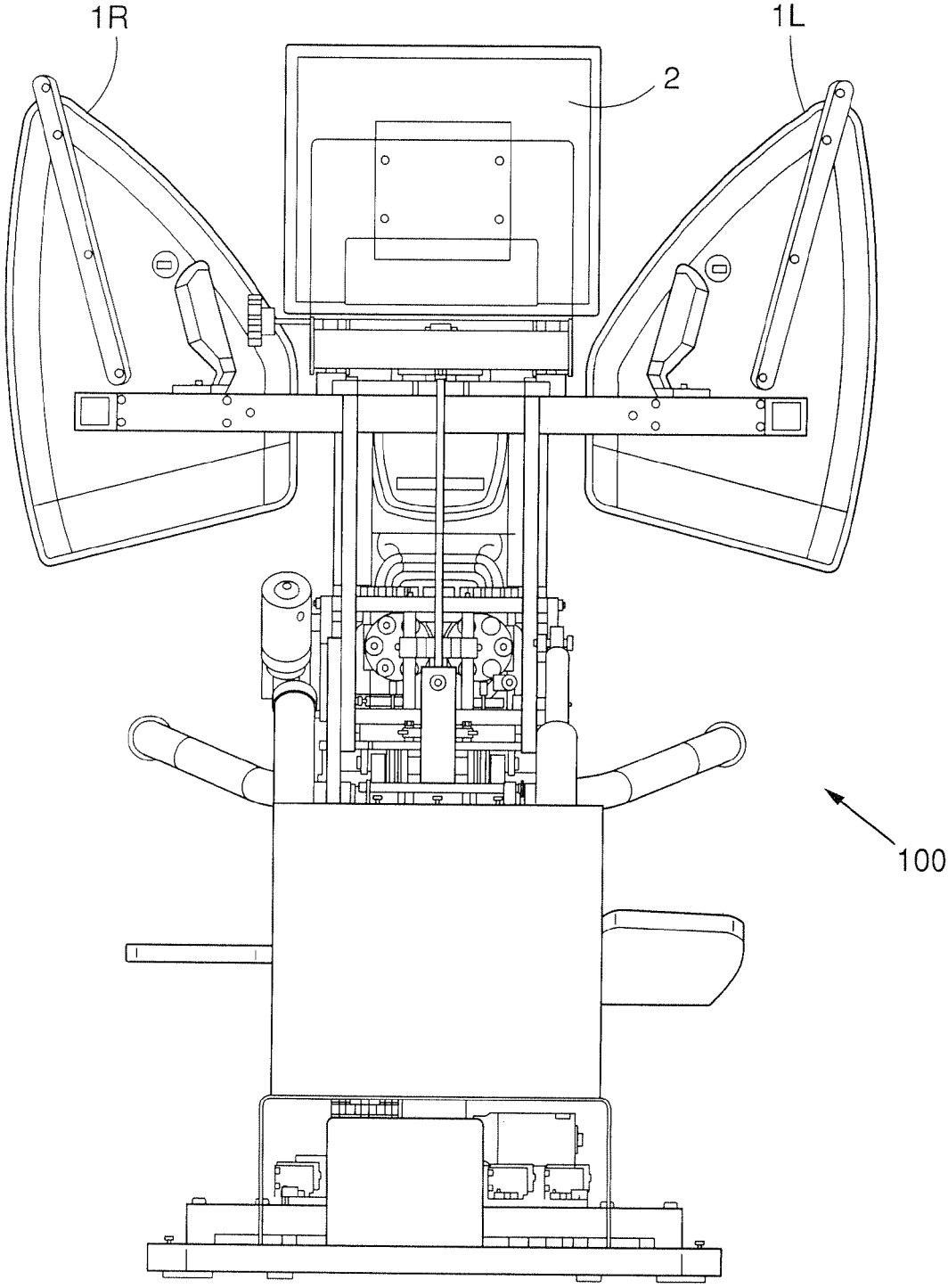
FIGS. 2A-2C are front or back perspective views of the present invention.
Figure 2B:
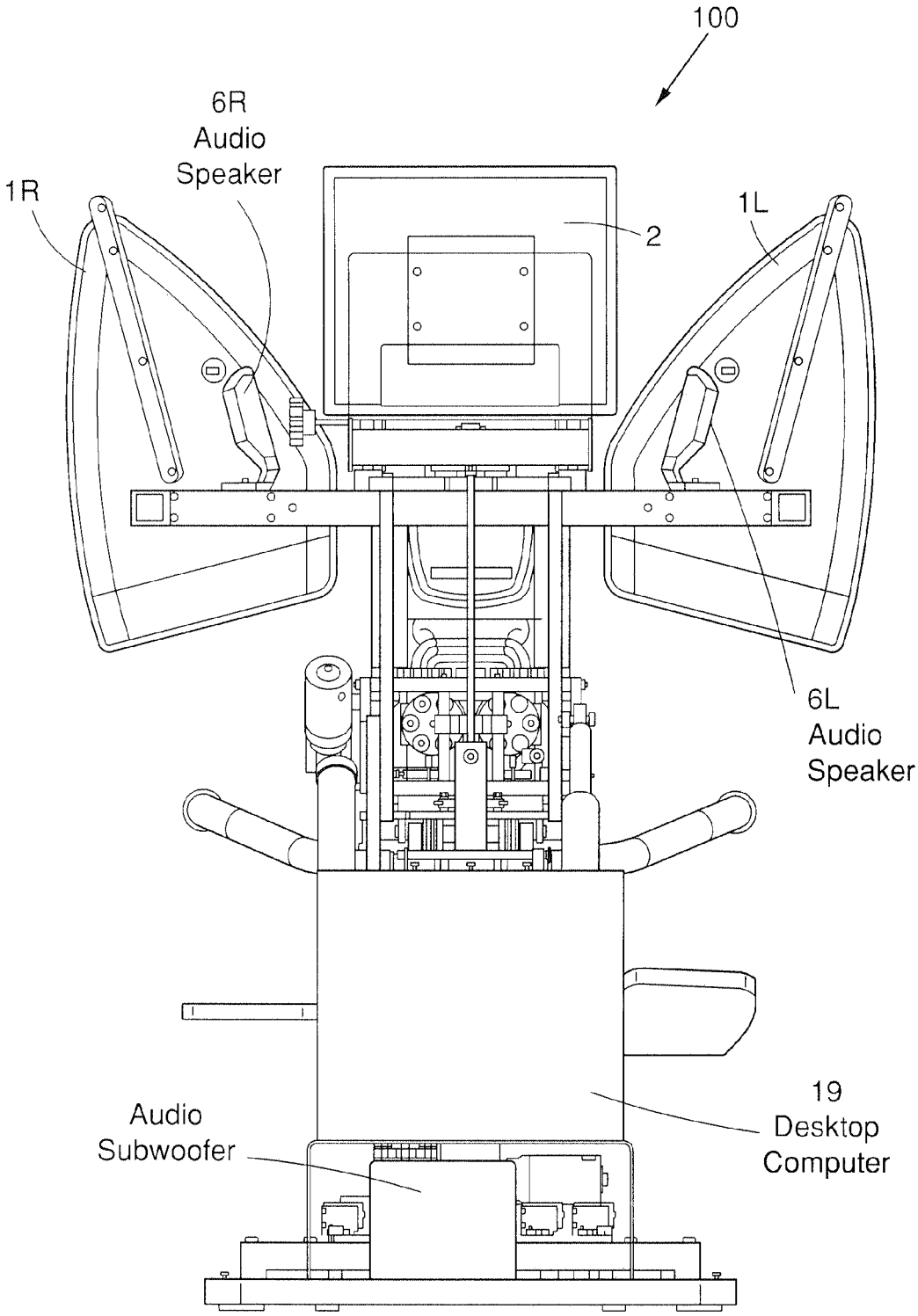
Figure 2C:
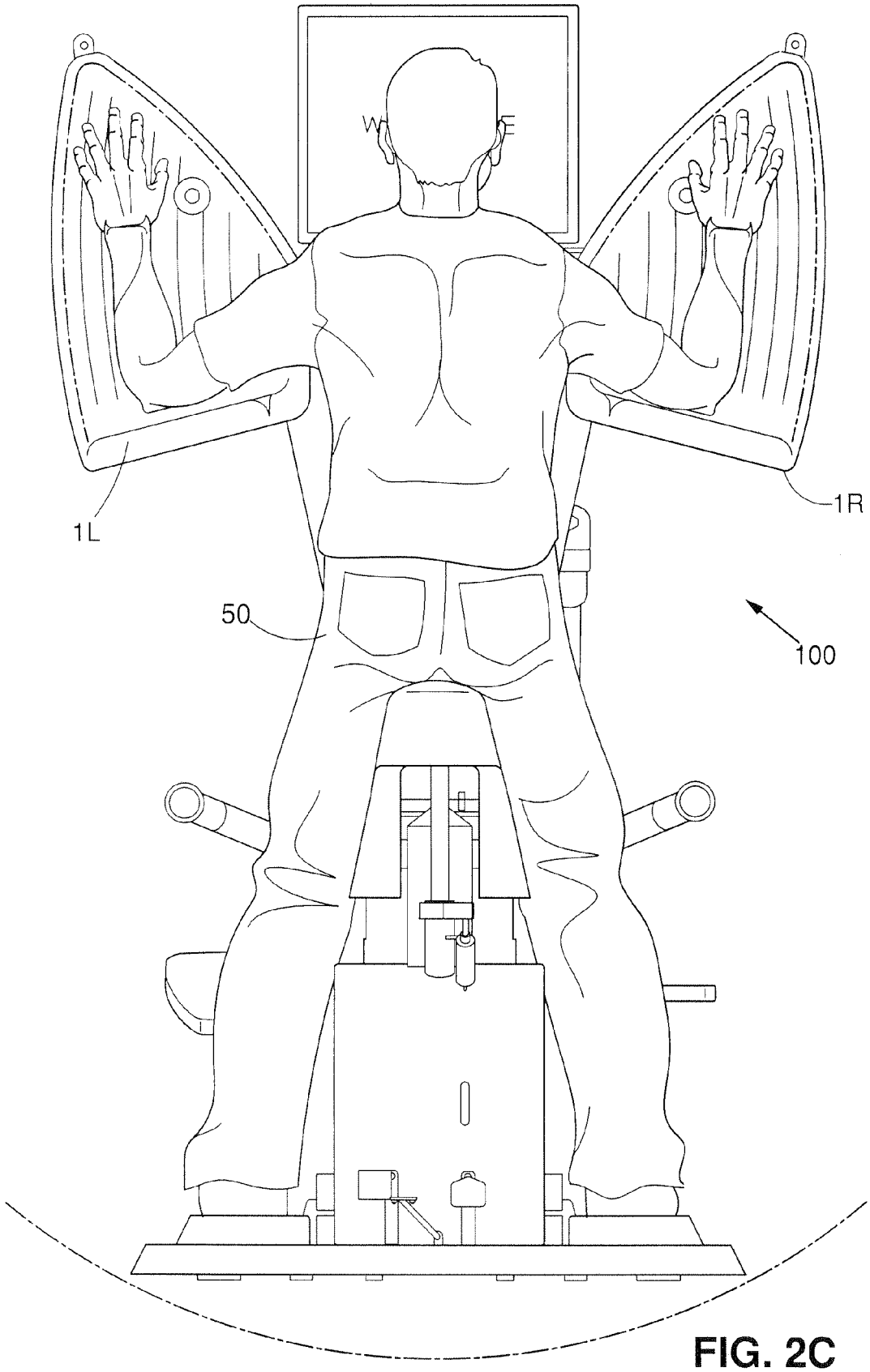

FIGS. 2A-2C are front or back perspective views of the present invention. Referring to FIGS. 1A and 2B, sound speakers 6R, 6L are mounted on the system 100. For example, the speakers 6R, 6L can be mounted on each arm support wing 1L, 1R, in front of the subject at the base of the torso shroud 3, or on the standing deck 7 under the subject's feet. The speakers 6R, 6L can be part of a therapeutic multimedia system, which is integrated with the system 100. Preferably, the integrated therapeutic multimedia system provides neurological rehabilitation by (a) navigation of 3-D virtual reality environments, (b) video guided eye exercises, (c) audio guided musculo-skeletal exercises, and (d) sound/vibratory therapy. As shown in FIG. 2B, software for providing the 3-D virtual reality and the video guided eye exercises can be stored on and executed from the computer 19 and displayed on the user interface 2. The sound vibrations can be generated using the audio subwoofer 20, as well as from the speakers 6R, 6L.

Figure 1B:
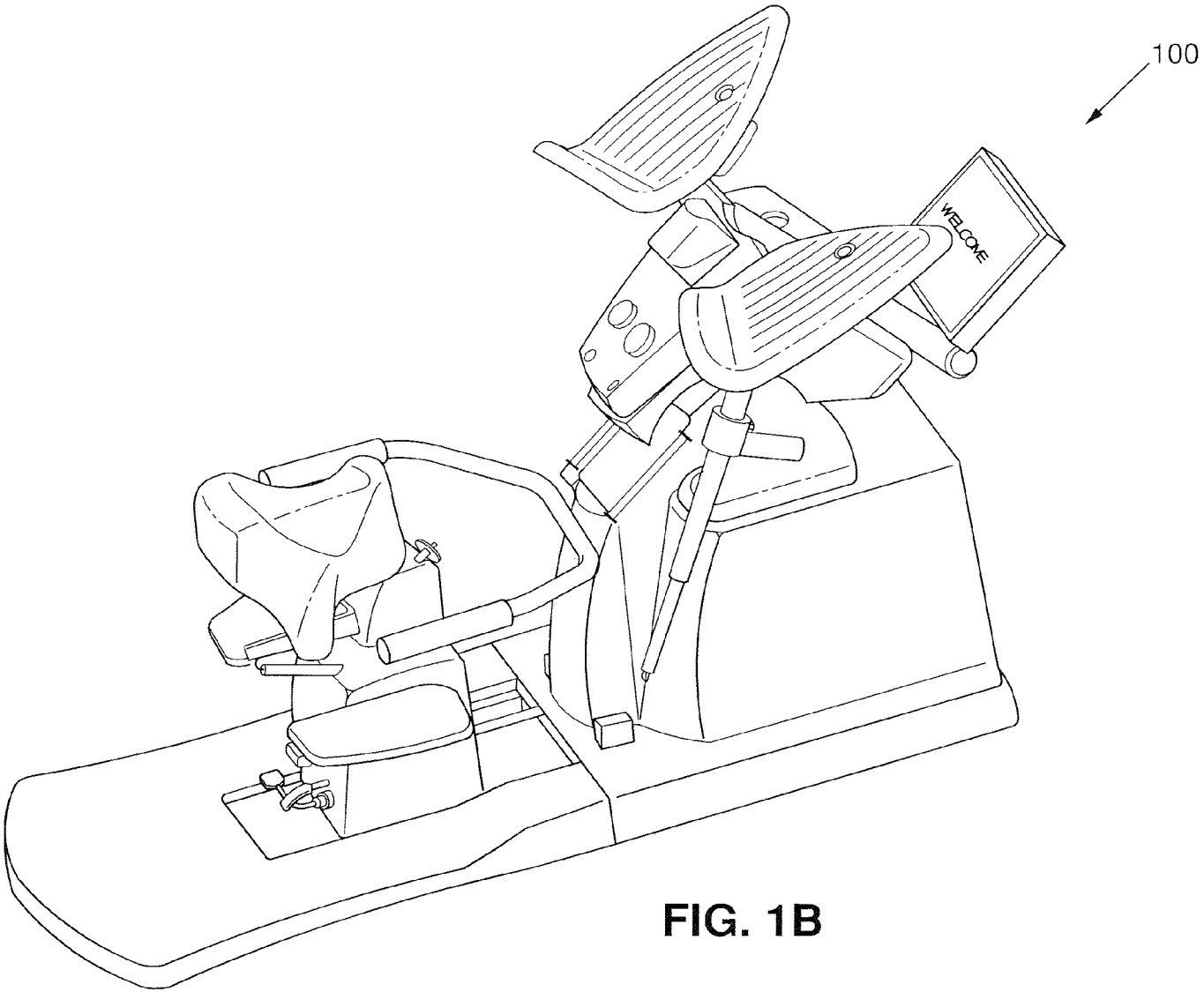
Figure 3A:
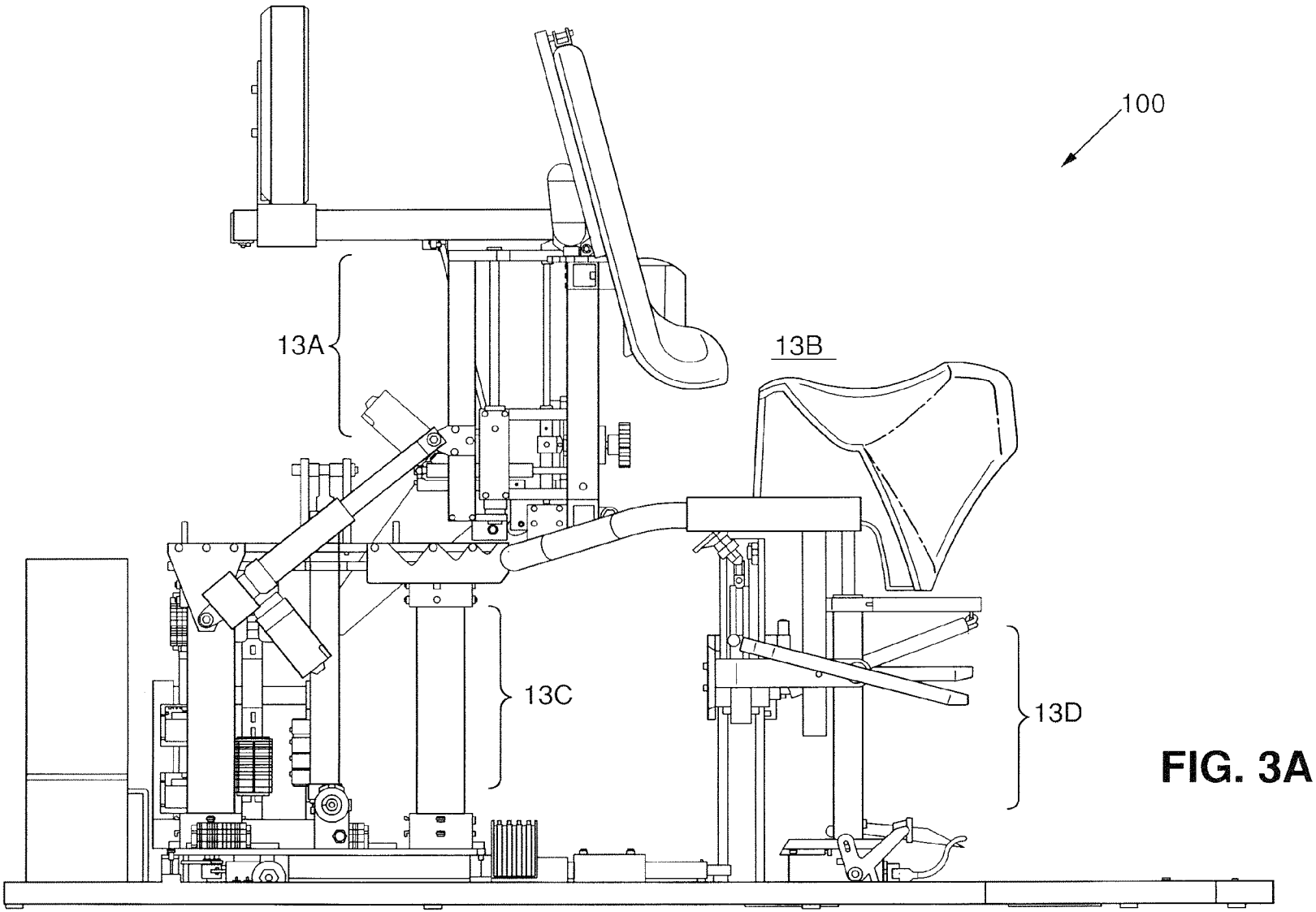
FIGS. 3A-3G are side perspective views of the present invention.
Figure 3B:
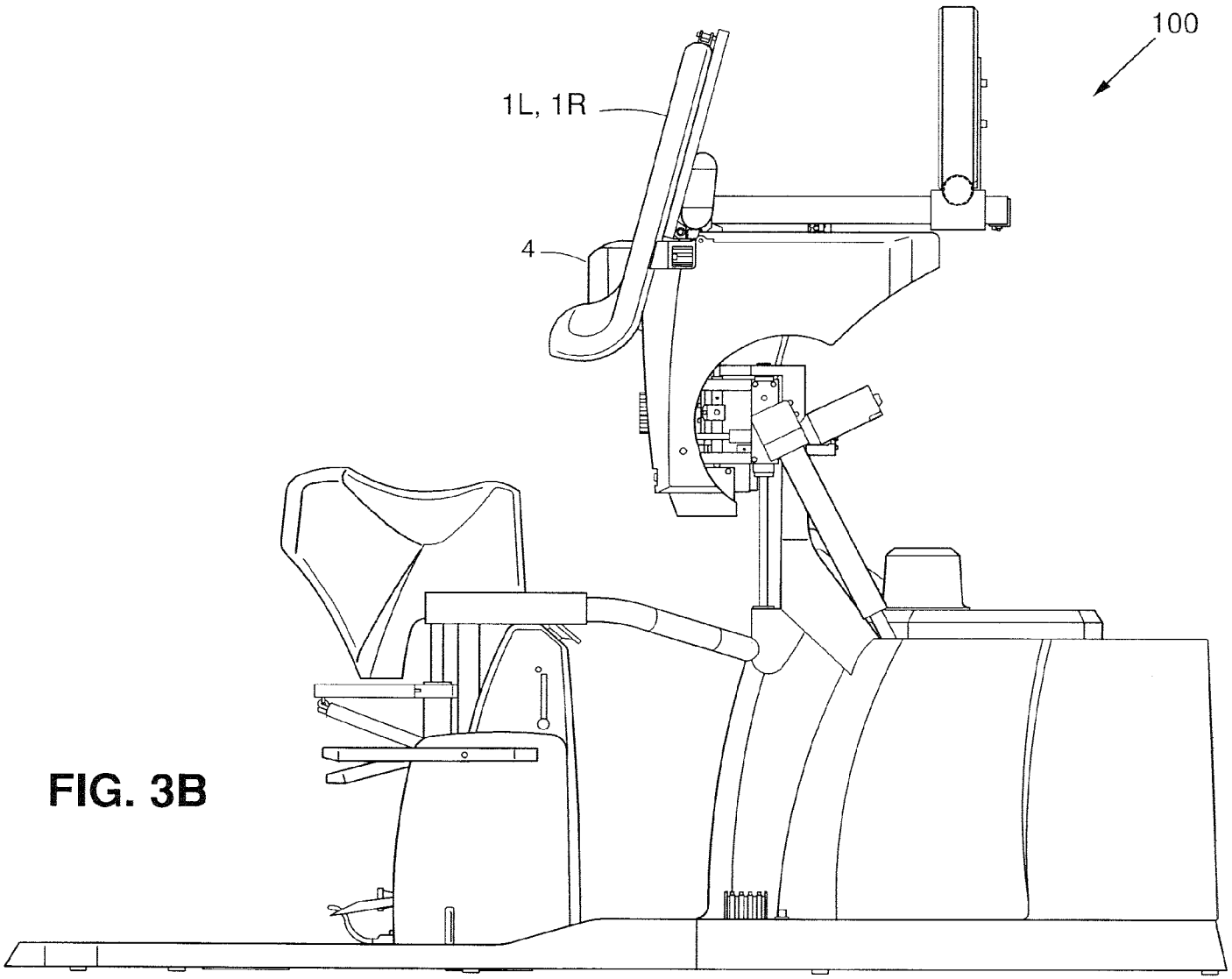
Figure 3C:
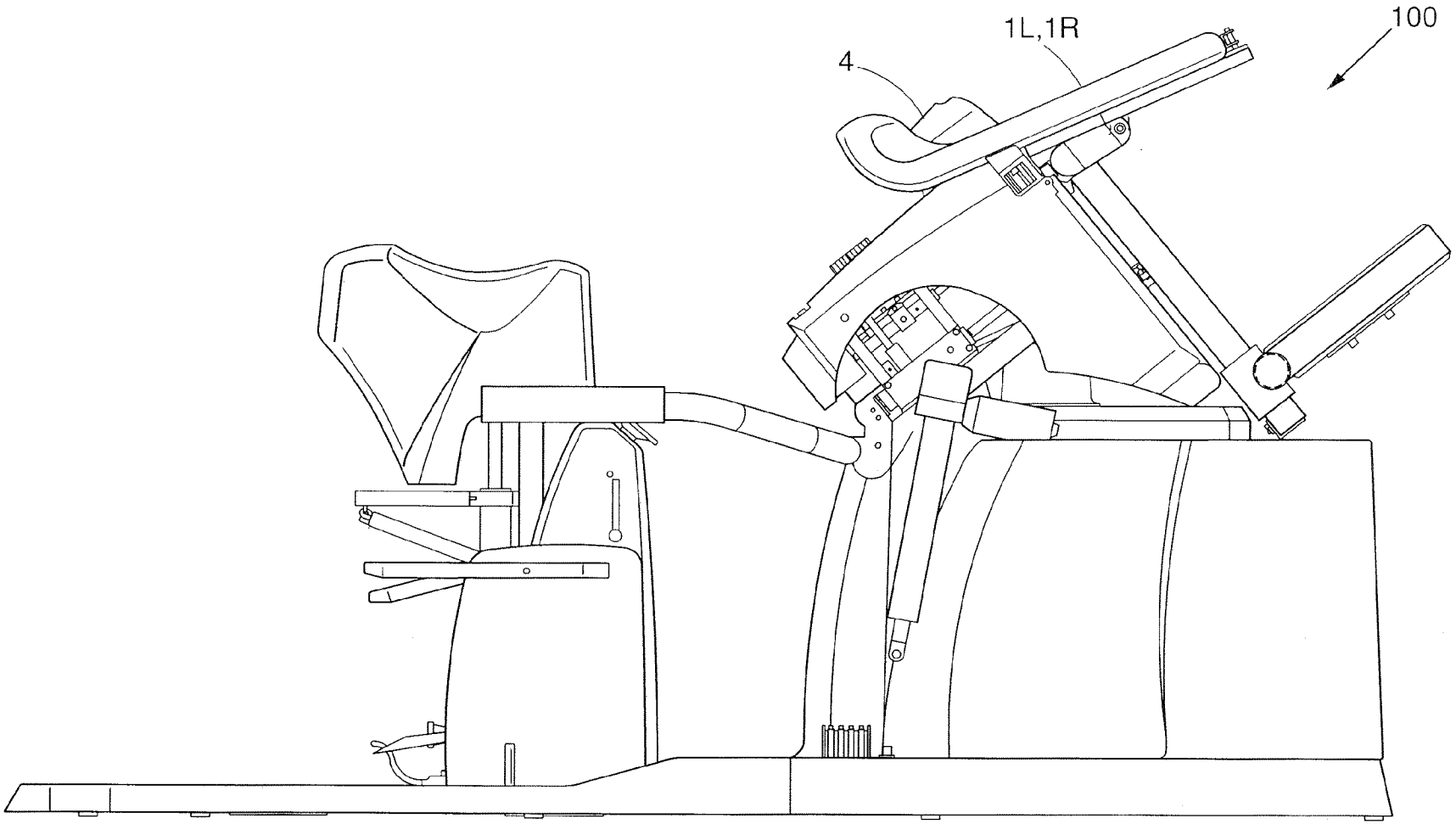
Figure 3D:
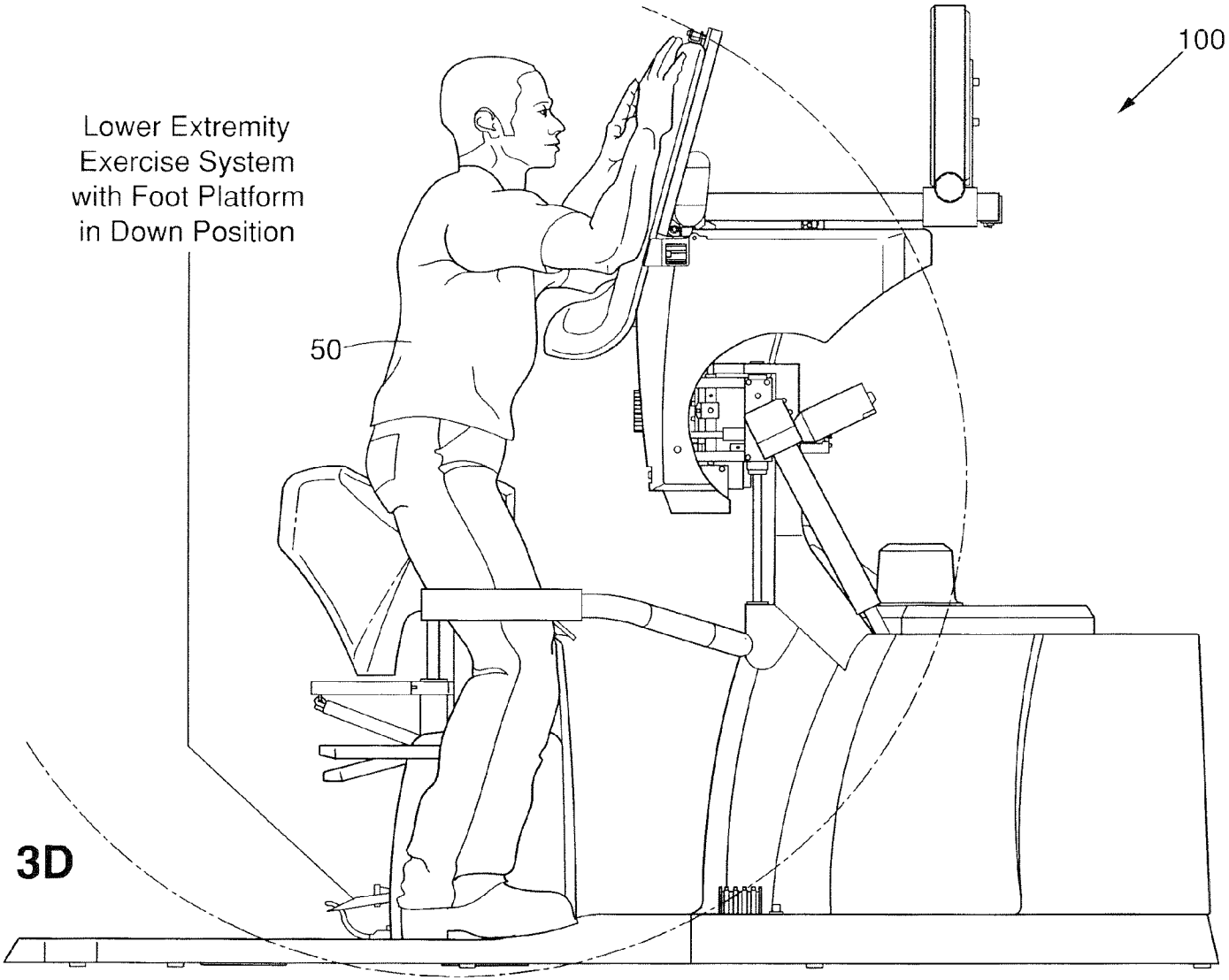
Figure 3E:
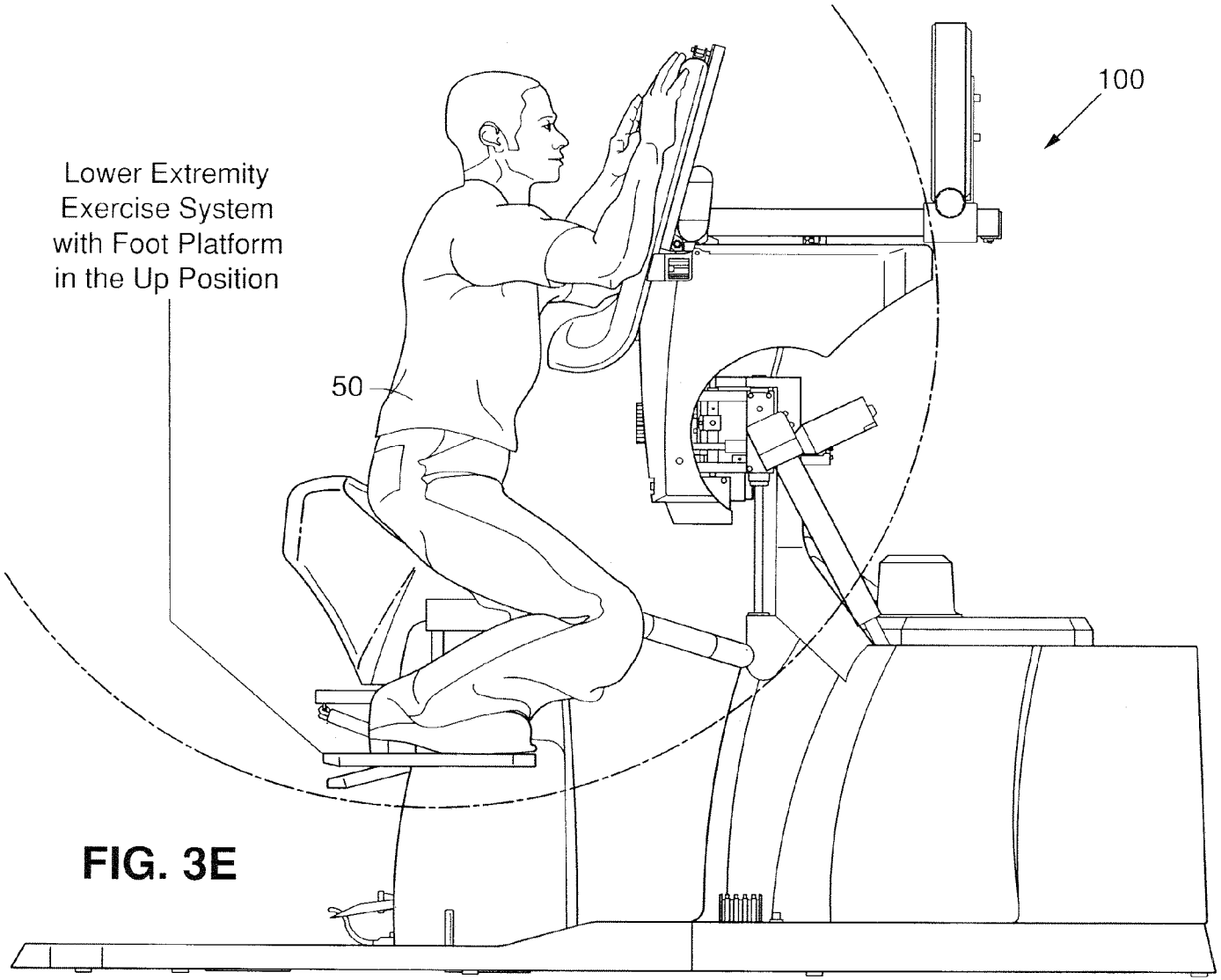
Figure 3F:
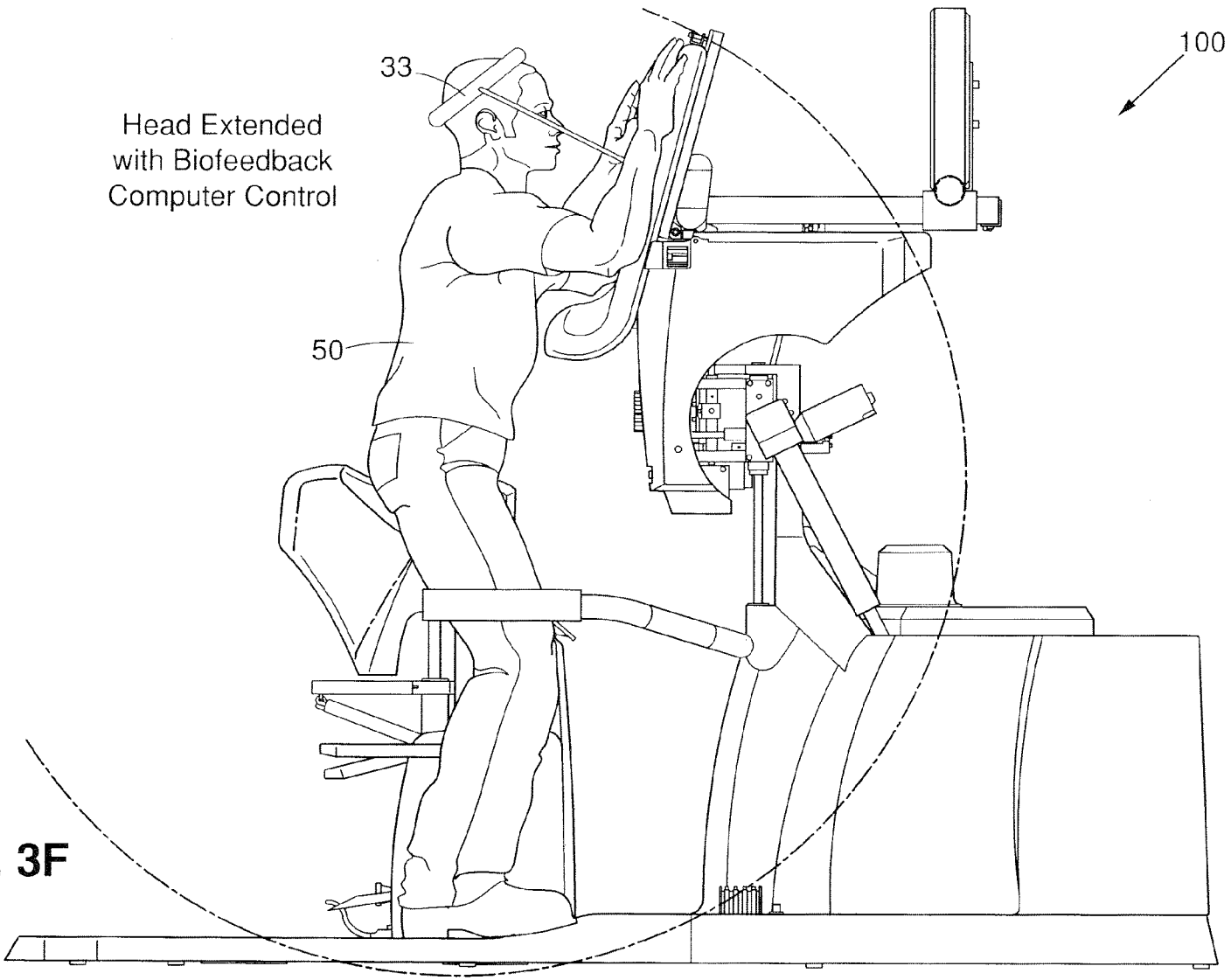
Figure 3G:
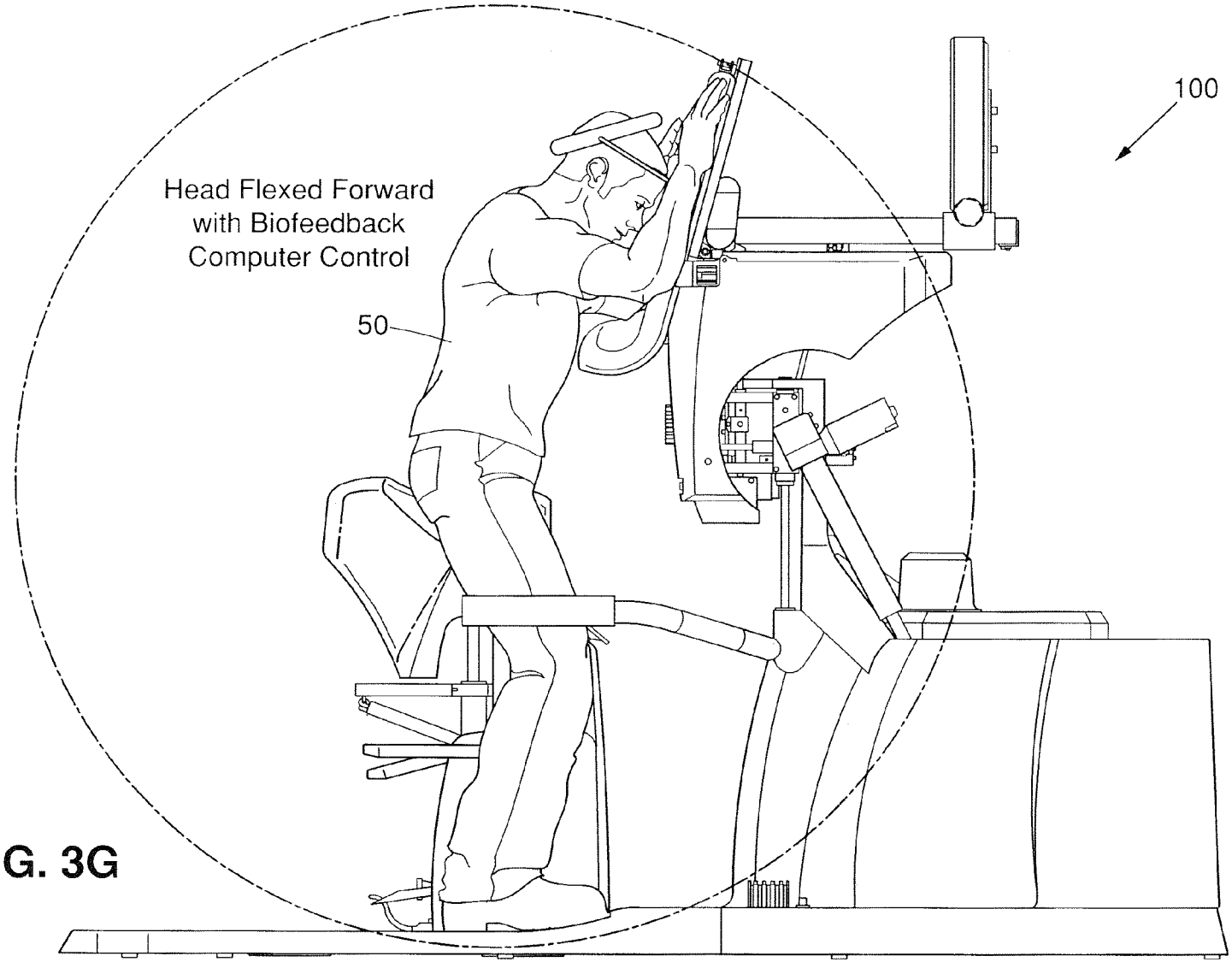

FIGS. 3A-3G are side perspective views of the present invention. A powered mechanism can be used in connection with the adjusting devices 13A, 13B, 13C, 13D to provide angle rotation to mimic the subject's position. For example, the powered mechanism can provide angle rotation as shown in FIG. 3G to mimic the subject's position while the subject is bending forward at the pelvis. The chest pad 4 and the wings 1L, 1R may be on powered feature that causes the chest pad 4 or the wings 1L, 1R to be vertically raised up and down and angled. Preferably, these are electromechanically powered pads, which are powered through a remote control. Often, each subject's chest may be a different distance from the subject's waist, and thus, by providing a powered mechanism, the angle of the system can be customized to correspond to the subject's angle at the subject's chest. For example, as shown in FIGS. 3C and 1B, the chest pad 4 and the wings 1L, 1R of the system 100 can be angled to a position that optimizes the subject's upright standing posture. FIG. 3B shows the chest pad 4 and the wings 1L, 1R in a default position, while FIG. 3C shows the chest pad 4 and the wings 1L, 1R at an incline.

FIGS. 3A-3G are side perspective views of the present invention. As shown in FIG. 3A, the adjusting members 13A, 13B, and 13C provide angle rotation that mimics the subject's rotating position at the torso. For example, FIG. 3B shows the system 100 in a standard default 100 position, while FIG. 3C shows the system 100 at an angled position. Referring to FIG. 3D, the system 100 positions the subject 50 to an upright standing posture and has the foot platform in the down position, and in FIG. 3E, the system 100 maintains the subject's upright standing posture position, while the foot platform is in the up position.

Referring to FIG. 3F, the head of the subject 50 can also be extended. As shown in FIG. 3G, the head of the subject 50 can be extended forward. Having the subject alternate between the positions shown in FIGS. 3D-3G, while maintaining an ideal posture in an upright standing position facilitates a predominantly isometric styled set of muscular activations. In particular, the combination of having the subject experience the audio visual presentation, while having the subject 50 maintain an upright standing posture in the positions shown in FIGS. 3D-3G provides unique access to the extensor portion of the subject's musculo-skeletal system. Specifically, each regional extensor pool can be systematically activated, in order to build coherence of the total extensor pool. The total extensor pool has components in the musculo-skeletal systems, which are bound seamlessly via the peripheral nervous system to its somato-topic representation within the central nervous system.

The subject's positioning can be monitored with the biofeedback computer control. The biofeedback control can use electronic or electromechanical instruments to accurately measure, process, and feed back status information to the subject, with reinforcing information, about the subject's positioning. This information can take the form of analog of auditory or visual feedback signals, or both. The biofeedback can help the subject develop greater awareness and control over his or her posture. For example, the system can provide the subject feedback about whether the subject is rounding his or her back or slouching.

As shown in FIG. 3F, the HALO head strap apparatus 33 can be used to provide biofeedback. As the subject pulls his or her head back from the position shown in FIG. 3G to the position shown in FIG. 3F a potentiometer switch attached to the apparatus will change the electrical signals sent to the computer. The result will be a change in either audio or visual signals represented on the computer screen. For example, as the subject pulls his or her head back, a dot will rise from the bottom of the computer screen towards the top. The rise of the dot on the computer screen is directly proportional to the extent of the subject head movement backward (the process is reversed as the head is rested forward). Another example, as the subject pulls his or her head back, the volume of an audio tone will increase, as the subject rests his or her head forward the volume will decrease.

Biofeedback can be provided in response to the subject rotating his or her torso. As the torso is rotated, the potential switch attached to that hardware will provide different electrical signals to the computer. The result will be a change in visual signals represented on the computer screen. For example, as the subject rotates his or her torso, a dot will move from either a right to left direction or a left to right on the computer screen, depending on the actual rotation of the subject. Rotation of the subject's torso to the right corresponds with movement of the dot to the right on the computer screen. Rotation of the subject's torso to the left corresponds with movement of the dot to the left on the computer screen.

The horizontal movement of the dot on the computer screen is directly proportional to the extent of the subject's rotation.

Biofeedback can also be provided in response to the movement in the subject's lower extremities. As the lower extremities are depressed downward from the position shown in FIG. 3E to the fully extended position shown in FIG. 3D, a potentiometer switch provides different electrical signals to the computer. The result will be a change in either audio or visual signals represented on the computer screen. For example, as the lower extremities are depressed a dot on the computer screen will also fall. Conversely, as the lower extremities rise the dot will also rise. The vertical rise and fall of the dot are directly proportional to the level of depression of the lower extremities. Another example, as the subject depresses his or her lower extremities the volume of an audio tone will increase, and as the subject raises his or her lower extremities, the volume will decrease.

Figure 4:
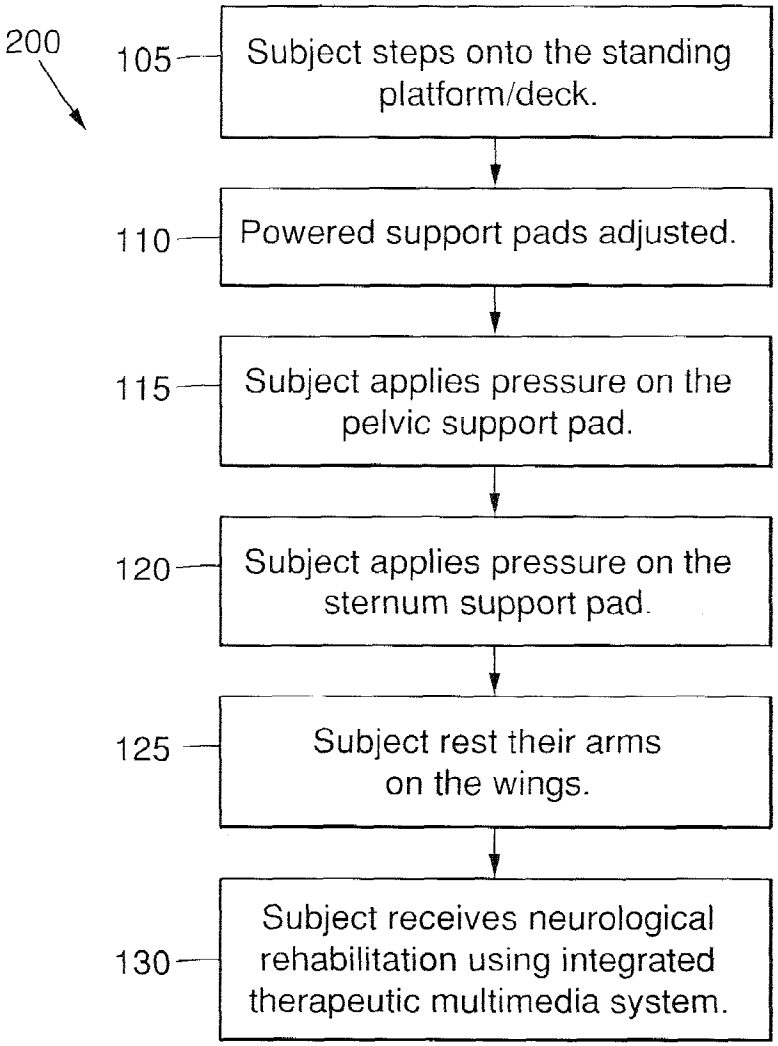
FIG. 4 is a flow diagram describing an example process 100 of using the present invention.
Figure 5:
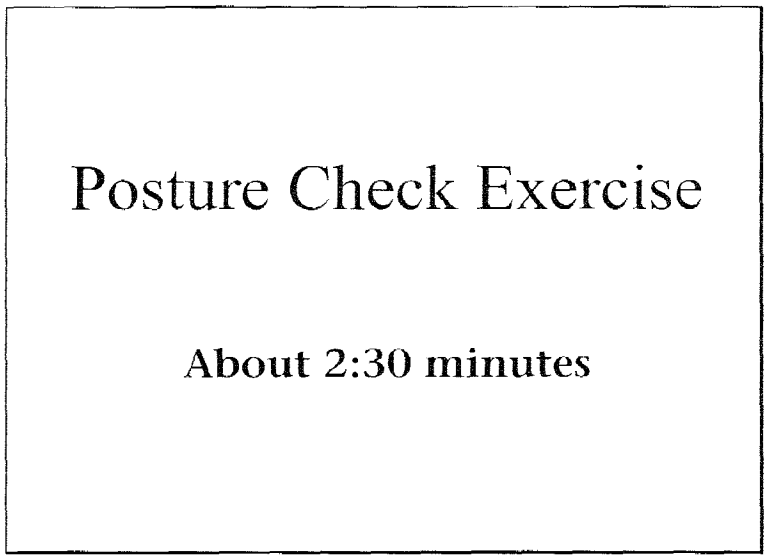
FIGS. 5-14 are example screenshots of operational instructions provided by the integrated therapeutic multimedia system of the present invention.
Figure 6:
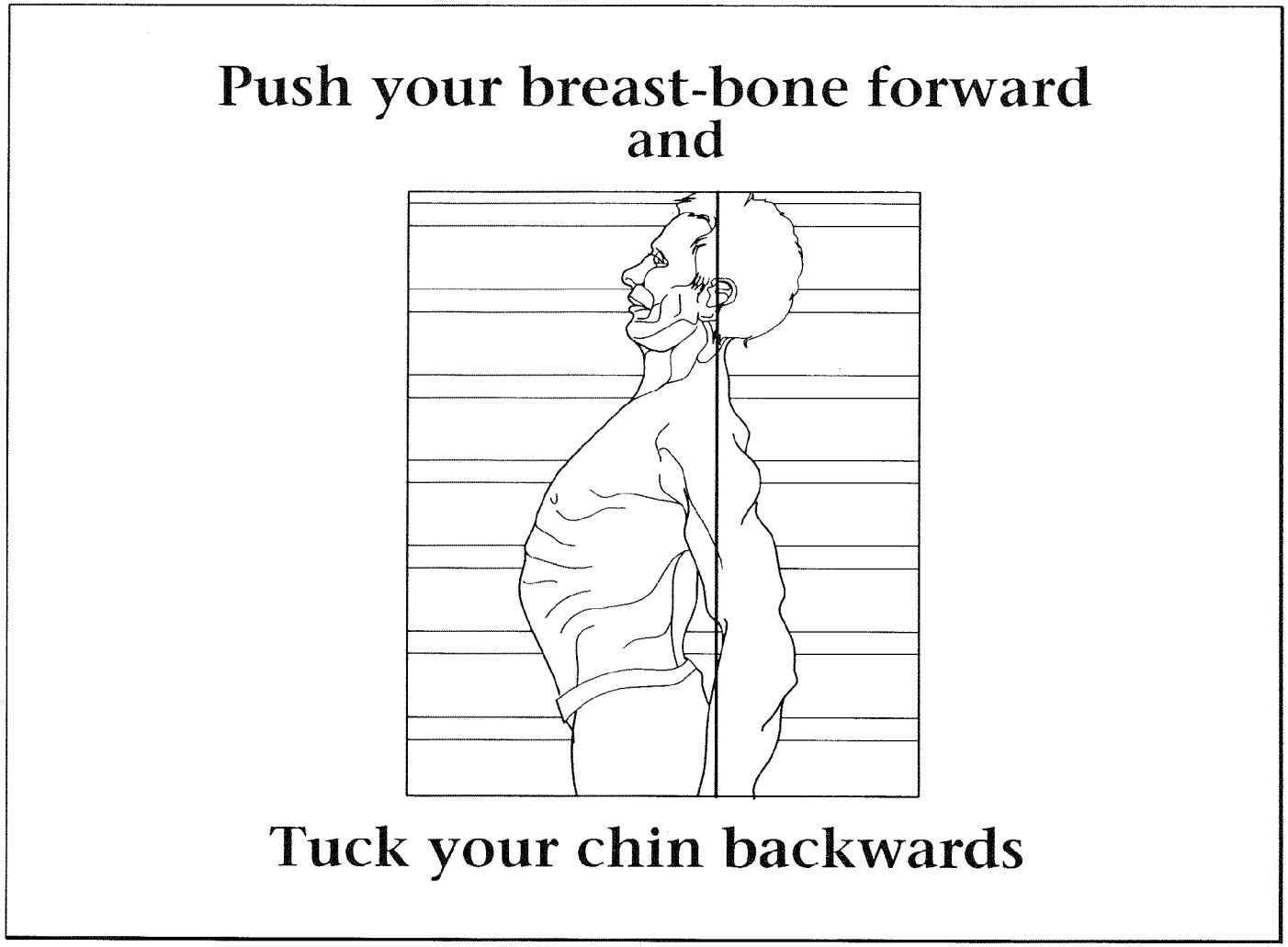
Figure 7:
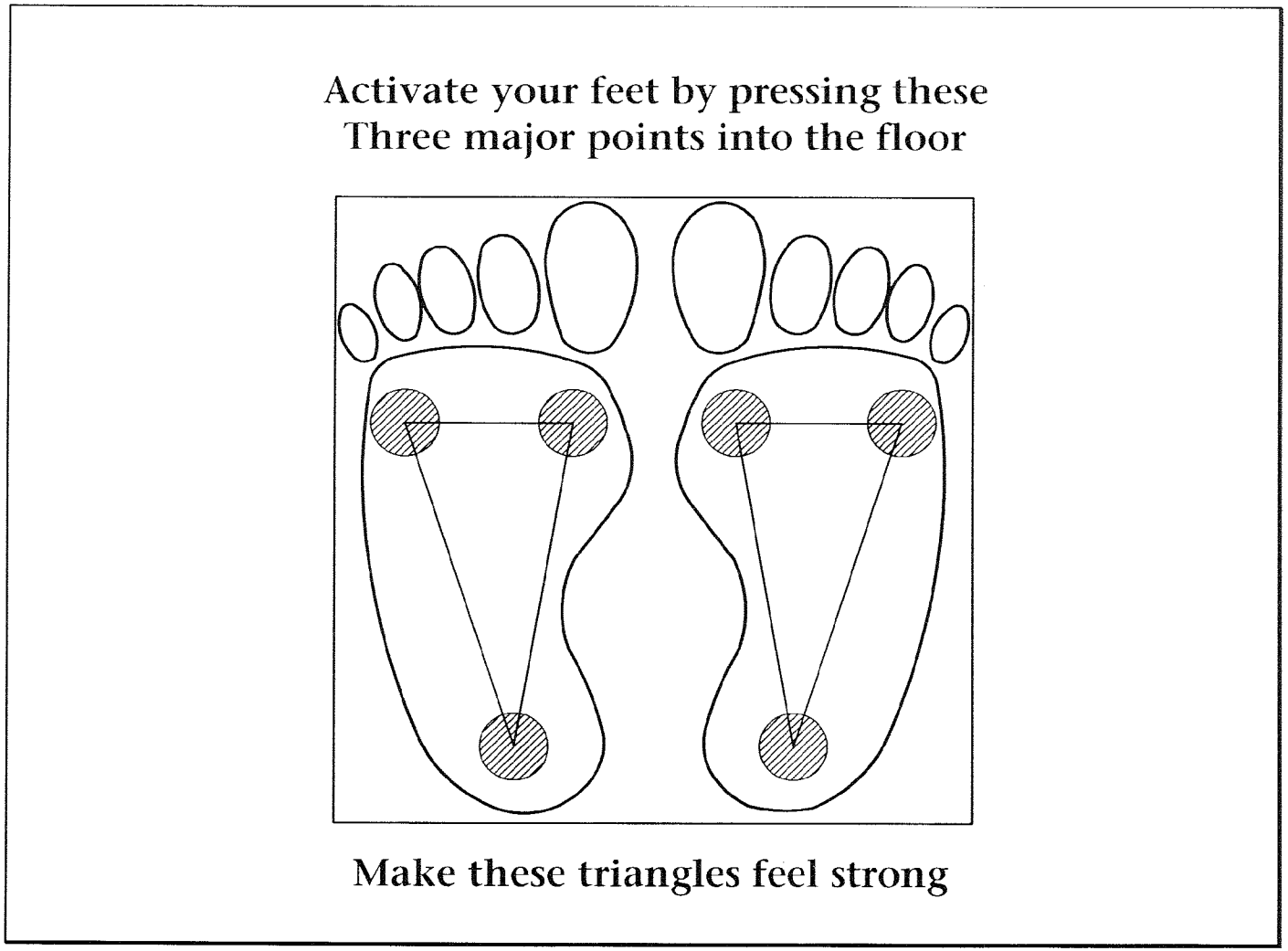
Figure 8:
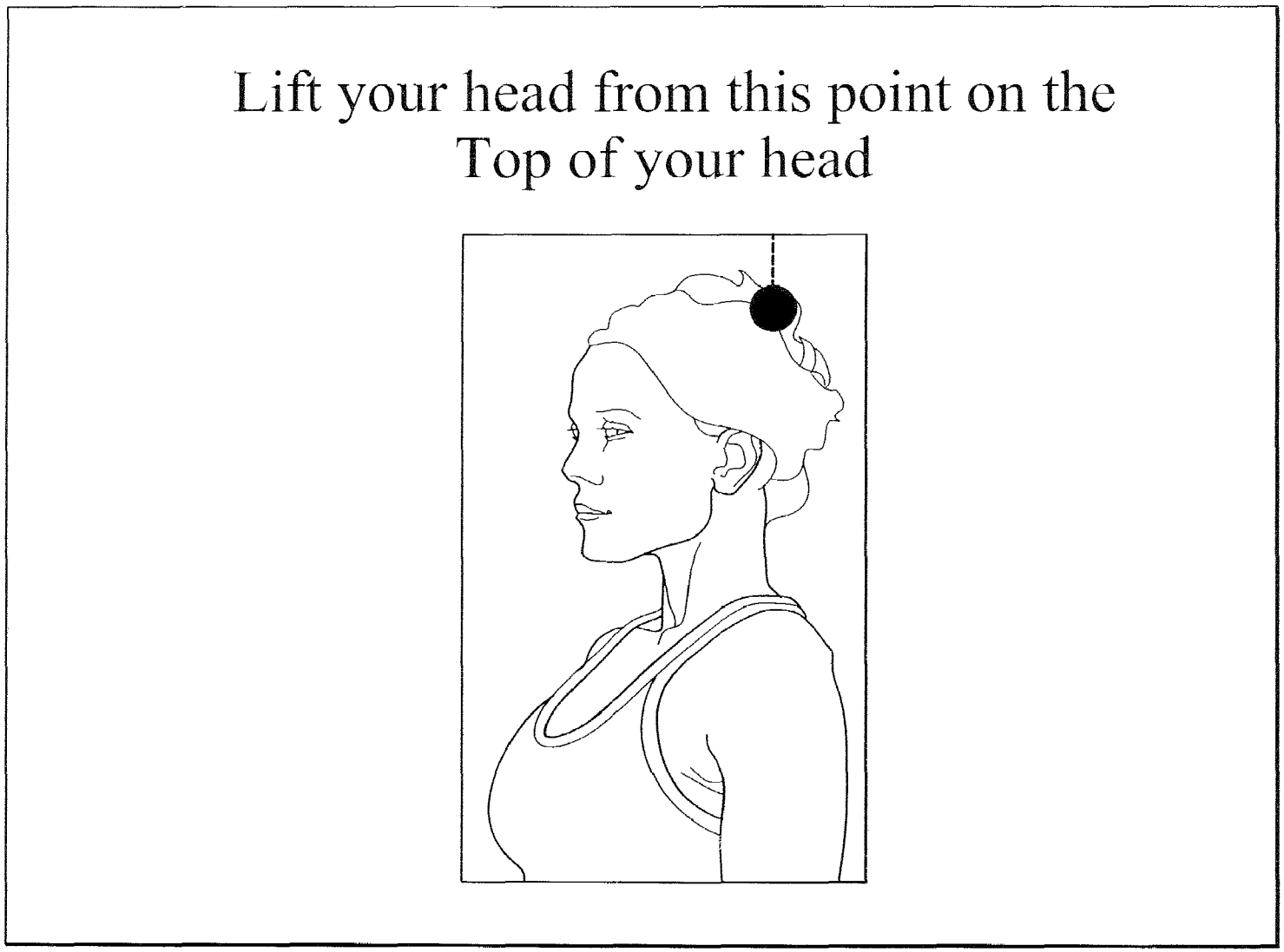
Figure 9:
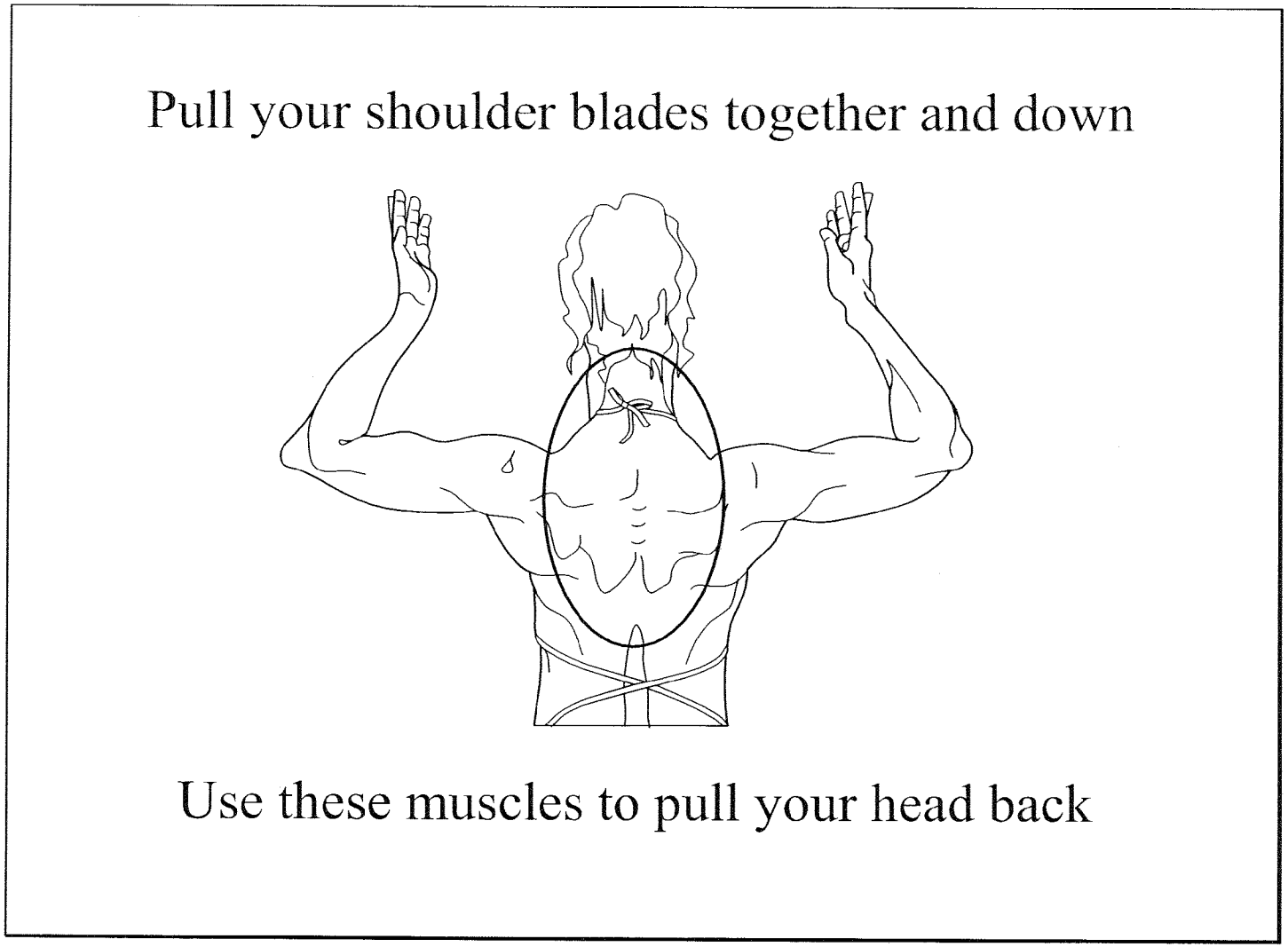
Figure 13:
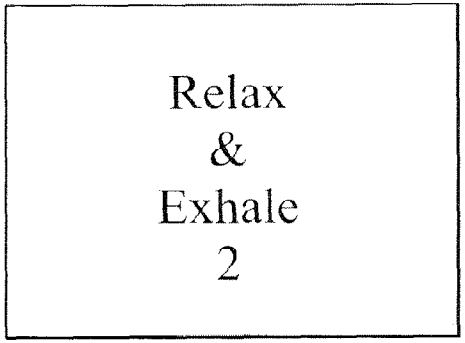
Figure 14:
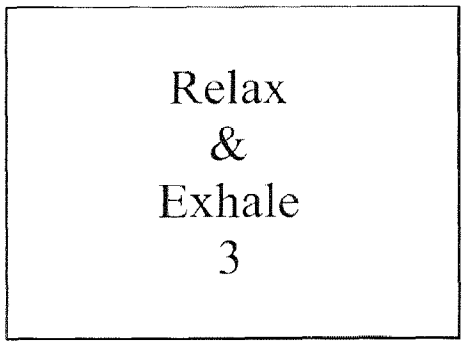
Figure 10:
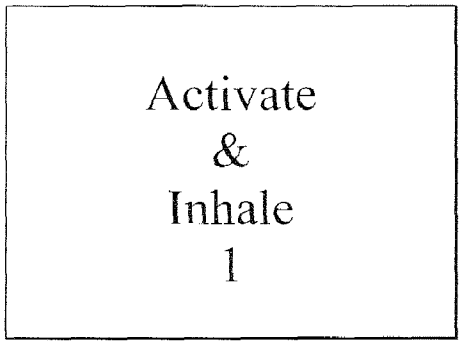
Figure 11:
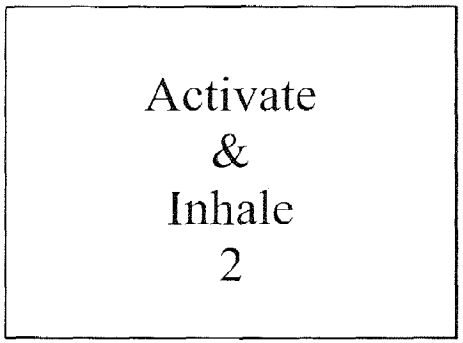
Figure 12:
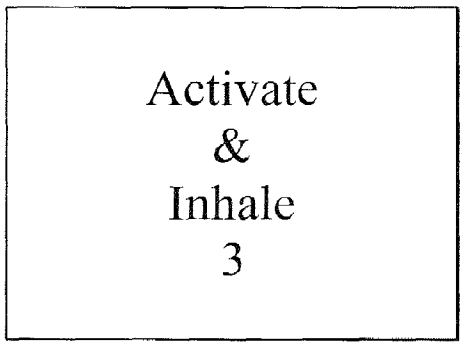

FIG. 4 is a flow diagram describing an example process 200 of using the present invention. At step 105, the subject steps onto the standing platform/deck. At step 110, the powered support pads can be adjusted to meet the positioning and size requirements of the subject and the therapy session. At step 115, the subject applies pressure on the pelvic support pad with his or her pelvis by leaning forward and dropping down, while still being supported by the present invention. At step 120, the subject applies pressure on the sternum support pad with his or her sternum by leaning forward and dropping down, while still being supported by the present invention. At step 125, the subjects rest the subject's arms on the wings. By applying forces counter to the support provided by the wings, sternum pad, and the pelvic pad, the subject effectively activates the extensor portion on his or her muscles. The subject can lean forward via the powered mechanism to adjust the position of the subject to accommodate the desired therapy. A diverse range of therapies are possible using the present invention, such as chiropractic musculo-skeletal therapy, proprioceptive rehabilitative therapy, rehabilitative training (e.g. stretching) and massage.

At step 130, the subject can experience visual, video and audio stimulation to aid in education and therapy. In particular, the present invention can provide this visual, video and audio stimulation using its integrated therapeutic multimedia system. Referring back to FIG. 2B, the integrated therapeutic multimedia system includes the video monitor 2 and the sound system 6R, 6L. The video/computer screen 2 and sound system 6R, 6L provide operational instructions (e.g. information, exercises, therapy treatments, and demos). Operational instructions may include instructions concerning the subject's appropriate use the present invention, instructions concerning the subject's appropriate position with respect to the present invention and instructions concerning the subject's expectations in connection with use of the present invention. Operational instructions may include anatomy and physiology education, including as audio-visual guided muscular skeletal exercises. The presentation displayed on the monitor 2 typically includes both audio and visual components. FIGS. 5-14 are example screenshots of operational instructional images generated on the display 2 provided by the integrated therapeutic multimedia system of the present invention.

The operational instructions include video guided eye exercises. The video guided eye exercises can allow the subject to look in specific places identified on the video screen for a specific period of time and track a target object on the video screen. The eye exercises stimulate brain activity and are part of the neurological therapeutic component of the present invention.

Figure 1C:
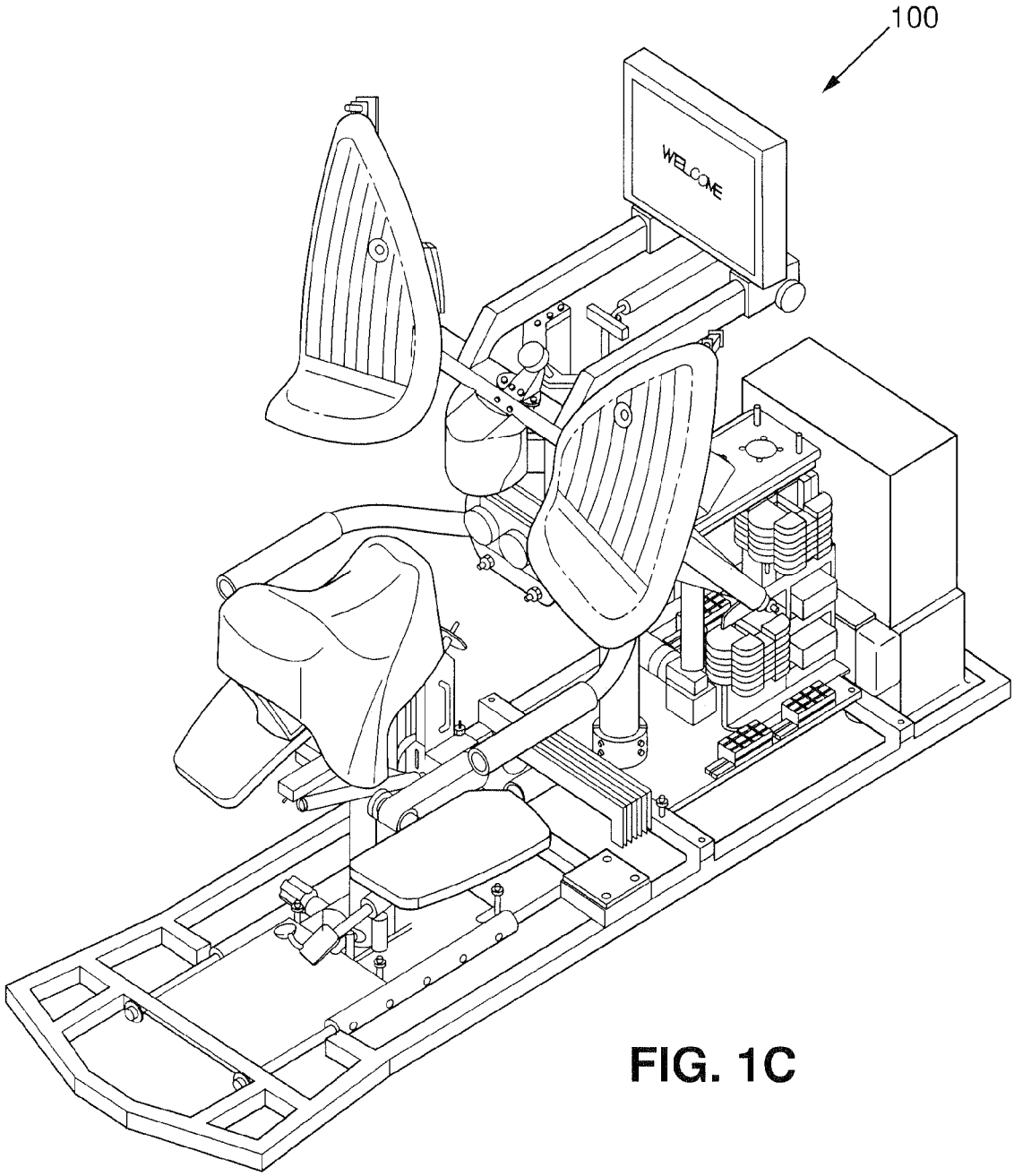
FIG. 1C is a top, front, right side cross-sectional perspective view of the present invention.

The operational instructions may include audio stimulation. The subject can experience audio stimulation to aid in education and therapy. For example, referring to FIGS. 1-3, speakers 6 emit vibrations that provide sound and vibration therapy. The sounds emitted can be any type of sound. Examples of sounds are specific tones of specific frequencies, such as chimes, that may be used to provide a soothing and relaxing experience. The tones are also used to keep tempo for exercises that are performed by the subject, such as the postural exercises and extensor-based exercises.

The present invention can provide navigation of 3-D virtual reality environments shown on the video screen 1. A subject can use the moving parts of the present invention as a mouse/pointer device, which allows the subject to navigate through 3-D virtual reality environment via the video 1 and audio 6 components. Preferably, the video 1 and audio 6 components are associated with a computer system, which includes a computer processor for processing the operational instructions to be shown on the video screen 1. The moving parts of the present invention can be used to communicate with the computer system and receive feedback from the subject. Feedback may include information about the posture of the subject and the results of exercises performed using the present invention. This feedback information can be used to create a report for analysis and diagnosis of the subject.

Figure 15:
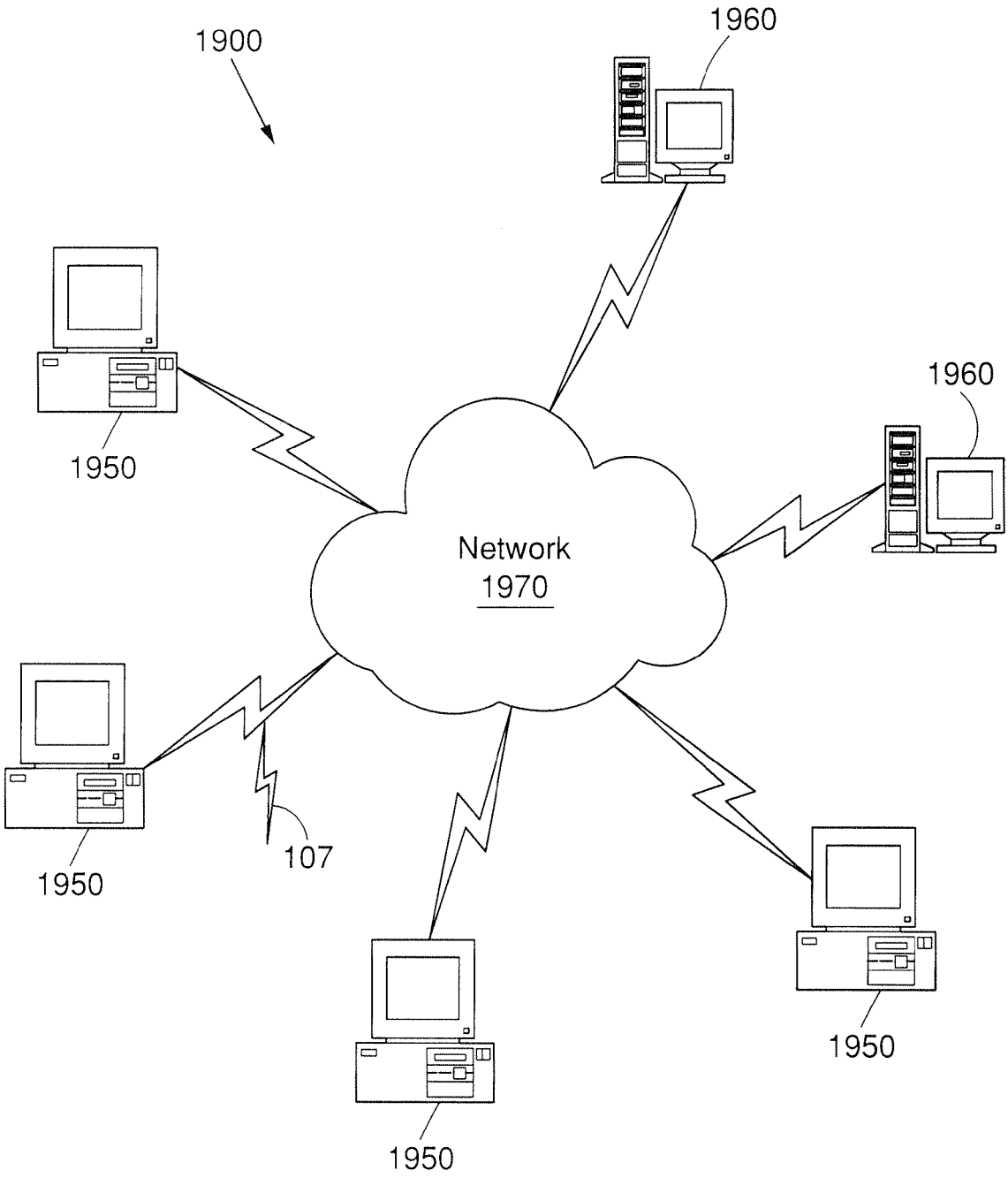
FIG. 15 is a schematic illustration of a computer network or similar digital processing environment in which the integrated therapeutic multimedia system embodiments of the present invention may be implemented.

FIG. 15 illustrates a computer network or similar digital processing environment 1900 in which the integrated therapeutic multimedia system of the present invention may be implemented. Client computer(s)/devices 1950 and server computer(s) 1960 provide processing, storage, and input/output devices executing application programs and the like. Client computer(s)/devices 1950 can also be linked through communications network 1970 to other computing devices, including other client devices/processes 1950 and server computer(s) 1960. Communications network 1970 can be part of a remote access network, a global network (e.g., the Internet), a worldwide collection of computers, Local area or Wide area networks, and gateways that currently use respective protocols (TCP/IP, Bluetooth, etc.) to communicate with one another. Other electronic device/computer network architectures are suitable.

Figure 16:
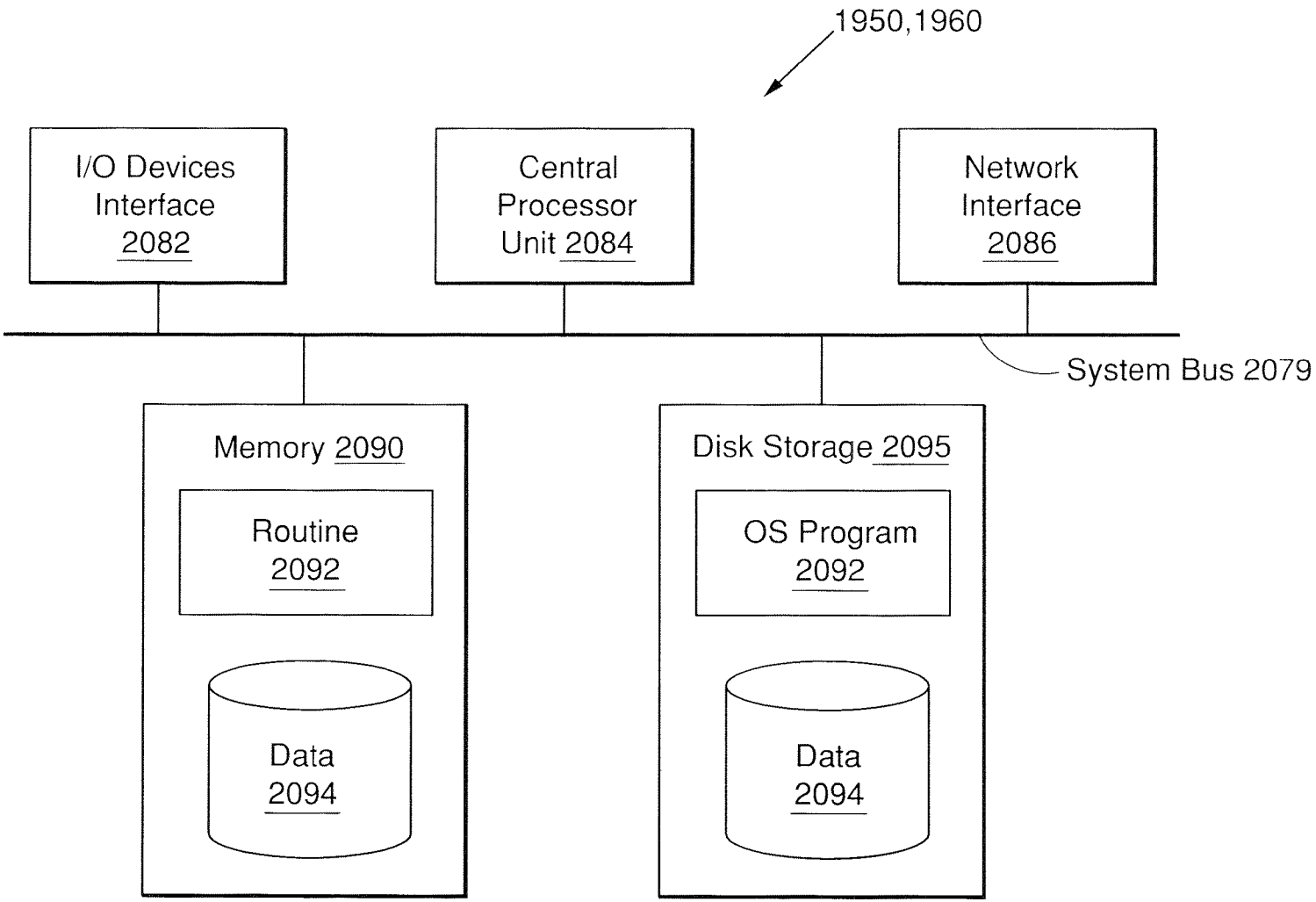
FIG. 16 is a block diagram of the internal structure of a computer of the network of FIG. 15.

FIG. 16 is a diagram of the internal structure of a computer (e.g., client processor/device 1950 or server computers 1960) in the computer system of FIG. 15. Each computer 1950, 1960 contains system bus 2079, where a bus is a set of hardware lines used for data transfer among the components of a computer or processing system. Bus 2079 is essentially a shared conduit that connects different elements of a computer system (e.g., processor, disk storage, memory, input/output ports, network ports, etc.) that enables the transfer of information between the elements. Attached to system bus 2079 is an Input/Output (I/O) device interface 2082 for connecting various input and output devices (e.g., keyboard, mouse, displays, printers, speakers, etc.) to the computer 1950, 1960. Network interface 2086 allows the computer to connect to various other devices attached to a network (e.g., network 1970 of FIG. 19). Memory 2090 provides volatile storage for computer software instructions 2092 and data 2094 used to implement an embodiment of the present invention (e.g., object models, codec and object model library discussed above). Disk storage 2095 provides non-volatile storage for computer software instructions 2092 and data 2094 used to implement an embodiment of the present invention. Central processor unit 2084 is also attached to system bus 2079 and provides for the execution of computer instructions.

In one embodiment, the processor routines 2092 and data 2094 are a computer program product, including a computer readable medium (e.g., a removable storage medium, such as one or more DVD-ROM's, CD-ROM's, diskettes, tapes, hard drives, etc.) that provides at least a portion of the software instructions for the integrated therapeutic multimedia system of the invention system. The computer program product can be installed by any suitable software installation procedure, as is well known in the art. In another embodiment, at least a portion of the software instructions may also be downloaded over a cable, communication and/or wireless connection. In other embodiments, the invention programs are a computer program propagated signal product embodied on a propagated signal on a propagation medium (e.g., a radio wave, an infrared wave, a laser wave, a sound wave, or an electrical wave propagated over a global network, such as the Internet, or other network(s)). Such carrier medium or signals provide at least a portion of the software instructions for the present invention routines/program 2092.

In alternate embodiments, the propagated signal is an analog carrier wave or digital signal carried on the propagated medium. For example, the propagated signal may be a digitized signal propagated over a global network (e.g., the Internet), a telecommunications network, or other network. In one embodiment, the propagated signal is a signal that is transmitted over the propagation medium over a period of time, such as the instructions for a software application sent in packets over a network over a period of milliseconds, seconds, minutes, or longer. In another embodiment, the computer readable medium of computer program product is a propagation medium that the computer system may receive and read, such as by receiving the propagation medium and identifying a propagated signal embodied in the propagation medium, as described above for computer program propagated signal product.

Generally speaking, the term "carrier medium" or transient carrier encompasses the foregoing transient signals, propagated signals, propagated medium, storage medium and the like.

While this invention has been particularly shown and described with references to preferred embodiments thereof, it will be understood by those skilled in the art that various changes in form and details may be made therein without departing from the scope of the invention encompassed by the appended claims.

For example, the present invention may be implemented in a variety of computer architectures. The computer network of FIGS. 15-16 are for purposes of illustration and not limitation of the present invention.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Some examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories, which provide temporary storage of at least some program code in order to reduce the number of times code are retrieved from bulk storage during execution.

I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The invention claimed is:

1. A method of rehabilitating posture, the method comprising the steps of: using a posture rehabilitation apparatus, causing a user to stand in an upright position to enable access to extensor muscle groups of the user's body including, isolating and activating extensor muscle groups of the user's body without substantially activating flexor muscle groups of the user's body; and using an integrated therapeutic multimedia computer system coupled to the posture rehabilitation apparatus for neurological rehabilitation while the user maintains the upright position posture, further comprising the steps of: (a) providing the user with video guided eye exercises, (b) providing the user with audio guided musculo-skeletal exercises, (c) providing the user with sound and vibratory therapy, (d) enabling the user to navigate through 3-D virtual reality guided exercises, where the user's posture is monitored with biofeedback using a head strap apparatus, the head strap apparatus includes a potentiometer switch to control audio or visual signals represented on a computer screen, the computer screen displaying the 3-D virtual reality guided exercises; and (e) monitoring the user's posture with biofeedback using the head strap apparatus.

2. The method of rehabilitating posture as in claim 1 wherein the integrated therapeutic multimedia computer system further includes a video display device for providing the user with video guided eye exercises.

3. The method of rehabilitating posture as in claim 1 wherein the integrated therapeutic multimedia computer system further includes a sound system to provide the audio guided musculo-skeletal exercises.

4. The method of rehabilitating posture as in claim 1 wherein the sound vibration therapy includes chimes.

5. The method of rehabilitating posture as in claim 1 wherein the integrated therapeutic multimedia computer system provides neurological rehabilitation by enabling the user to interact with a multimedia presentation of 3-D virtual reality exercise demonstrations.

6. The method of rehabilitating posture as in claim 1 wherein monitoring the user's posture with biofeedback using the head strap apparatus further includes producing a report of findings.

7. The method of rehabilitating posture as in claim 1 wherein the posture rehabilitation apparatus further includes a foot platform providing foot support, the foot platform being capable of moving to an up position and down position.

8. The method of rehabilitating posture as in claim 1 wherein the posture rehabilitation apparatus further includes a seat for the user to sit on, while ensuring that the user maintains upright posture.

9. The method of rehabilitating posture as in claim 1 wherein the posture rehabilitation apparatus further includes an adjustable chest pad that is capable of being angled to a position that optimizes the user's upright standing posture.

10. The method of rehabilitating posture as in claim 1 wherein the biofeedback further includes the computer screen displaying an object, where the displayed object moves in response to the user pulling his or her head back, the movement of the object being directly proportional to the user's head movement.

11. A posture rehabilitation apparatus comprising: a human body positioning system having a torso shroud and a chest pad connected to the torso shroud, left and right arm supports connected to the torso shroud, the chest pad being substantially between the left and right arm supports, the human body positioning system enabling a user to stand in an upright position to provide access to extensor muscle groups of the user's body including isolating and activating the extensor muscle groups of the user's body; and an integrated therapeutic multimedia computer system, coupled to the human body positioning system, capable of providing the user with neurological rehabilitation by (a) providing a video display connected to the torso shroud for providing the user with video guided eye exercises, (b) providing the user with audio guided musculo-skeletal exercises, (c) providing the user with sound and vibratory therapy, (d) enabling the user to navigate through 3-D virtual reality guided exercises, where the user's posture is monitored with biofeedback using a head strap apparatus, the head strap apparatus includes a potentiometer switch to control audio or visual signals represented on the video display, the video display displaying the 3-D virtual reality guided exercises; and (e) monitoring the user's posture with biofeedback using the head strap apparatus; and an adjusting device for adjusting an angle of the torso shroud, chest pad, left and right arm supports, and video display with respect to the user.

12. The posture rehabilitation apparatus as in claim 11 wherein the integrated therapeutic multimedia computer system further includes a sound system providing the user with audio guided musculo-skeletal exercises.

13. The posture rehabilitation apparatus as in claim 11 wherein the sound and vibration therapy includes chimes.

14. The posture rehabilitation apparatus as in claim 11 wherein the integrated therapeutic multimedia computer system provides neurological rehabilitation by enabling the user to interact with a multimedia presentation of 3-D virtual reality exercise demonstrations.

15. The posture rehabilitation apparatus as in claim 11 wherein the biofeedback further includes a report generated specifying findings.

16. The posture rehabilitation apparatus as in claim 11 wherein the human body positioning system further includes a foot platform providing foot support, the foot platform being capable of moving to an up position and down position.

17. The posture rehabilitation apparatus as in claim 11 wherein the human body positioning system further includes a seat for the user to sit on, while still ensuring that the user maintains upright posture.

18. The posture rehabilitation apparatus as in claim 11 wherein the chest pad is adjustable such that it is capable of being angled to a position that optimizes the user's upright standing posture.

19. The posture rehabilitation apparatus as in claim 11 wherein the biofeedback further includes the video display displaying an object, where the displayed object moves in response to the user pulling his or her head back, the movement of the object being directly proportional to the user's head movement.

* * * * *